US011982086B2

(12) United States Patent
Sritharan et al.

(10) Patent No.: US 11,982,086 B2
(45) Date of Patent: May 14, 2024

(54) ULTRA HIGH-PERFORMANCE CONCRETE BOND ANCHOR

(71) Applicant: Iowa State University Research Foundation, Inc., Ames, IA (US)

(72) Inventors: Sivalingam Sritharan, Ames, IA (US); Satish Hansmukhlal Jain, Mira Road East (IN)

(73) Assignee: Iowa State University Research Foundation, Inc., Ames, IA (US)

( * ) Notice: Subject to any disclaimer, the term of this patent is extended or adjusted under 35 U.S.C. 154(b) by 603 days.

(21) Appl. No.: 17/247,573

(22) Filed: Dec. 16, 2020

(65) Prior Publication Data

US 2022/0186497 A1 Jun. 16, 2022

(51) Int. Cl.
*E04C 5/08* (2006.01)
*E04C 5/12* (2006.01)

(52) U.S. Cl.
CPC . *E04C 5/12* (2013.01); *E04C 5/08* (2013.01)

(58) Field of Classification Search
CPC ..... E04C 5/08; E04C 3/26; E04C 3/12; E04C 3/125; E04C 5/122
USPC ..... 52/223.14
See application file for complete search history.

(56) References Cited

U.S. PATENT DOCUMENTS 2,177,364 A * 10/1939 Fotsch ..... F16G 11/048 24/122.3
2,180,866 A * 11/1939 Cryer ..... E01F 15/06 52/223.14
3,935,685 A * 2/1976 Howlett ..... E04C 5/12 29/523
3,952,377 A * 4/1976 Morell ..... E04C 5/122 403/374.2
3,979,186 A * 9/1976 Mizuma ..... E04C 5/08 428/592
4,627,762 A * 12/1986 Scotti ..... F16G 11/048 403/369

(Continued)

OTHER PUBLICATIONS

Taha et al., "New Concrete Anchors for Carbon Fiber-Reinforced Polymer Post-Tensioning Tendons—Part 1: State-of-the-Art Review/Design", ACI Structural Journal, pp. 86-95, Jan. 2003.

(Continued)

*Primary Examiner* — Paola Agudelo
(74) *Attorney, Agent, or Firm* — McKee, Voorhees & Sease, PLC

(57) ABSTRACT

Ultra-High-Performance Concrete (UHPC), owing to its superior mechanical and durability properties, presents a unique opportunity for innovative use in unbonded post-tensioned floor systems. In unbonded post-tensioned (PT) slabs and beams, the use of cast-in-place steel confined UHPC Bond Anchors (UBA) can be used to anchor steel prestressing strands for better durability, increased strand ductility, cost-effectiveness, and ease of installation. A conical, steel confining device is used as part of the UBA. The device resists hoop tension and eliminates splitting cracks in the UHPC during prestress transfer. It also helps to reduce the anchorage length. High average bond stress helps reduce the UBA length, and consequently, the material consumption. The bond stress at the strand-UHPC interface can be increased by intentionally roughening or indenting the strand.

20 Claims, 26 Drawing Sheets
(23 of 26 Drawing Sheet(s) Filed in Color)

(56) References Cited

U.S. PATENT DOCUMENTS 5,054,146 A * 10/1991 Wiesenfeld ..... E21D 21/0026 405/259.5
5,079,879 A * 1/1992 Rodriguez ..... E04C 5/12 52/223.13
5,085,026 A * 2/1992 McGill ..... E04C 5/12 52/698
5,603,589 A * 2/1997 von Allmen ..... E02D 5/80 57/204
6,843,031 B1 * 1/2005 Sorkin ..... E04C 5/122 285/285.1
7,043,801 B2 * 5/2006 Toimil ..... F16G 11/106 24/136 R
8,425,143 B2 * 4/2013 Kondo ..... F16G 11/02 403/368
9,157,504 B2 * 10/2015 Watanabe ..... E04C 5/127
9,562,321 B2 * 2/2017 Manabe ..... D07B 1/005
2003/0233798 A1 * 12/2003 Berkey ..... E04C 5/08 52/223.6
2007/0028552 A1 * 2/2007 DeLoach ..... E04C 5/16 52/414
2008/0222981 A1 * 9/2008 De Gobbi ..... E04B 1/41 52/235
2016/0305140 A1 * 10/2016 Wilson ..... E04C 5/165
2020/0040543 A1 * 2/2020 Novarin ..... E02D 5/74

OTHER PUBLICATIONS

Taha et al., "New Concrete Anchors for Carbon Fiber-Reinforced Polymer Post-Tensioning Tendons—Part 2: Development/Experimental Investigation", ACI Structural Journal, pp. 96-104, Jan. 2003.

Weiher, Hermann, "Mechanical Anchorage made of UHPC for prestressed FRP-bar", Matrics Engineering GmbH, 7 pages, Jan. 2014.

* cited by examiner

| Length (mm) | O.D. (mm) | Wire Dia (mm) | Pitch (S) (mm) | Yield Stress (MPa) | Tensile Strength (MPa) |
|---|---|---|---|---|---|
| 305 | 80.2 mm | 8.7 mm | 23.2 mm | 930 | 1400 |

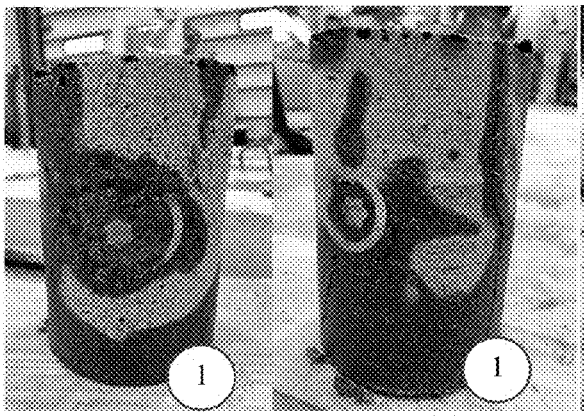
Figure 20A
Figure 20B
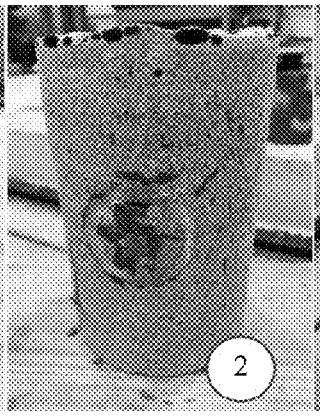
Figure 20C
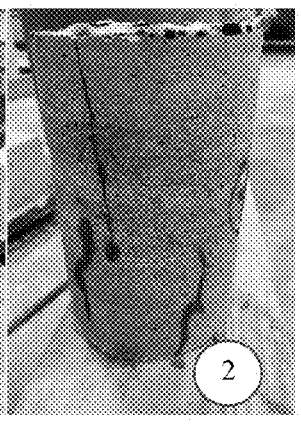
Figure 20D
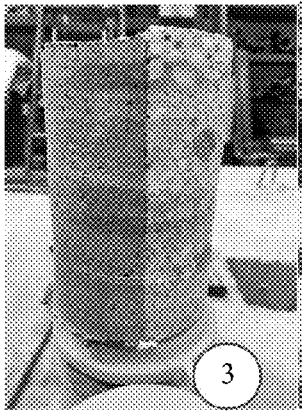
Figure 20E
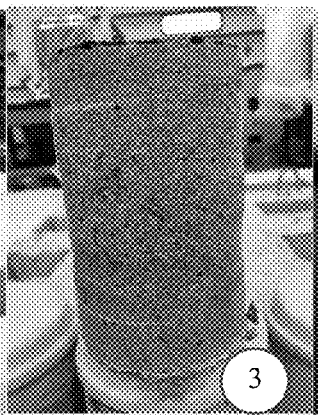
Figure 20F
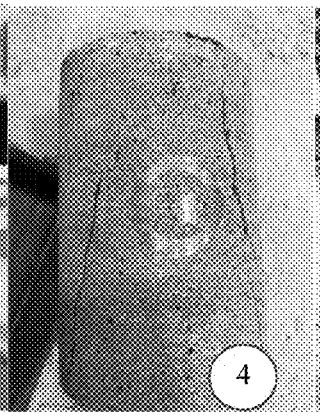
Figure 20G
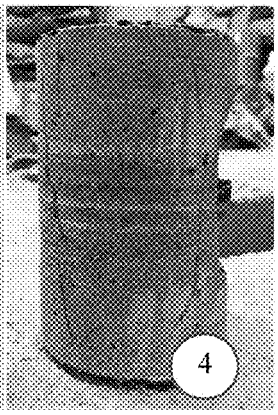
Figure 20H
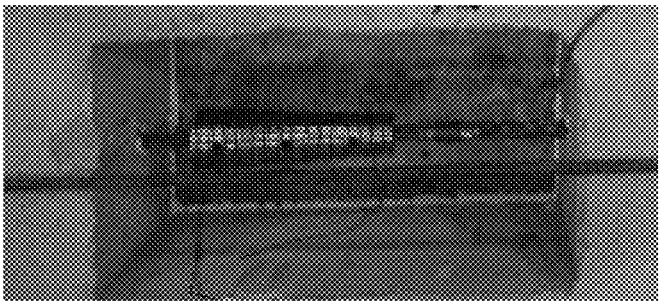
Figure 21A
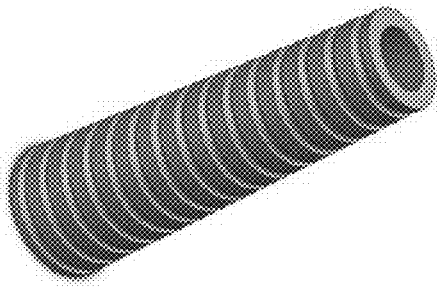
Figure 21B

ULTRA HIGH-PERFORMANCE CONCRETE BOND ANCHOR

FIELD OF THE INVENTION

The invention relates generally to construction materials for use in buildings, bridges, and the like. More particularly, but not exclusively, the invention relates to the use of Ultra High-Performance Concrete (UHPC), and the anchoring of the same to unbonded post-tensioned slabs.

BACKGROUND OF THE INVENTION

Concrete and steel have both been the primary construction material of choice for structural engineers in the design of high-rise buildings. The skyscrapers of the recent past were almost all built-in structural steel as concrete strengths in compression were limited, which required large column sizes and consumed valuable real-estate space. Also, conventional form-work and curing methods meant longer floor construction cycle. The advent of high-strength high-performance concrete gave a new make-over to the construction industry. The last twenty-five years have seen tremendous advancement in the use of High-Performance Concrete (HPC), leading to innovation in design as well as construction methodologies. Innovation in form-work systems, chemical admixtures, earthquake engineering, and post-tensioning system sped the revolution of concrete in the building industry. Today, concrete competes very well with steel and is considered as the material of choice for tall building construction.

Although much has been said and reported on advanced concrete technology, the post-tensioning industry appears to have not received its due credit for the success the concrete industry enjoys today. The end consumer is driving the building industry in the modern world. Long-span floor systems and flat slabs are in high demand by both consumers and architects alike. Reinforced concrete has struggled to keep up with this demand. Concrete creeps in the long-term under sustained loading and can lead to excessive deflections resulting in serviceability issues. Reinforced concrete also experiences cracking, unlike structural steel. The effective moment of inertia of cracked beams and slabs range from 25% to 50% of the gross moment of inertia. Hence, thicker concrete sections are required to make long-span concrete floor systems work under service loads, leading to excessive self-weight of the structure. The high self-weight puts a higher demand on columns, the lateral force-resisting elements, and the foundations. The bridge industry was already technically far ahead in the use of concrete for long-span girders, using a technology that is known as prestressing. The underlying philosophy of prestressing is two-pronged: a) it precompresses the concrete such that the concrete remains uncracked under service loads, and b) it provides load balancing by providing an inherent load opposing gravity. Two methods of prestressing can be used, namely, pretensioning and post-tensioning. In pretensioning, the strands are stressed before concreting, and once the concrete hardens and gains adequate strength, the strands are released to precompress the member. The other method, called post-tensioning, is used with cast-in-situ concrete, in which the strands are stressed after the hardening of concrete. Most concrete building structures are cast-in-situ, and the method of post-tensioning is commonly used in slabs and beams to achieve longer spans and reduce dead load. Advancement in post-tensioning systems through the introduction of low-relaxation PC strands, high tensile strength strands (1860 MPa), grease-filled and HDPE sheathed strands for unbonded post-tensioning, encapsulated anchorage systems, and specialized stressing jacks that reduce seating loss have contributed immensely to thinner and durable structural slabs with enhanced floor spans, enabling architectural creativity and efficiency.

HPC has grown many-fold and spread over more extensive regions of the world. The concrete industry is slowly seeing intermittent and incremental advances to meet future demands. It is of interest to note that structural steel buildings can still be 30 to 40% lighter than the current concrete structures. Durability remains a significant concern with concrete construction practices around the world. It is not the fault of the material but the unchecked spread of technology across the world without accountability in local jurisdictions, side-lining the specifications that go along with the application of modern methods, including unreasonable cost-cutting that has led to low-quality construction.

Ultra-High-Performance Concrete (UHPC), owing to its superior mechanical and durability properties, presents a unique opportunity for innovative use in unbonded post-tensioned floor systems. With superior mechanical and durability properties, UHPC is an ideal choice for shallow depth, long span beams in building floors. Long-span floor systems and flat slabs are in high demand by both consumers and architects alike. However, such an application has not been realized due to significantly high material cost making UHPC volume reduction critical for a cost-effective and optimal design solution for long-span beams.

UHPC is also called 'Ultra High-Performance Fiber-Reinforced Concrete' (UHPFRC), 'Ultra High-Performance Fiber Reinforced Composite,' and 'Reactive Powder Concrete' (RPC). UHPC is characterized by ultra-high mechanical and durability properties. It exhibits superior compressive strengths (>120 MPa), and sustained tensile post-peak ductility in tension, leading to fracture energy that could be 100 times that of conventional concrete. UHPC thus fills a critical gap between structural steel and concrete and opens up new areas of applied research in the design and construction of structures.

Owing to its superior mechanical properties, UHPC works very well with prestressing and can be used to create leaner and lighter long-span girders, when compared to HPC. Similarly, UHPC can also be used to create cost-effective alternates for structural steel sections and trusses. UHPC is also very durable; therefore, its use in the anchorage areas of post-tensioned concrete elements can help improve the longevity of the structure. Currently, UHPC is significantly more expensive than the cost of normal-strength concrete (about 10 to 15 times), but that cost still falls in between the cost of structural steel and concrete per unit volume and thus makes it attractive for innovation and futuristic design.

In unbonded post-tensioned (PT) slabs and beams, the use of steel confined ultra-high-performance concrete (UHPC) bond anchors has been suggested to anchor steel prestressing strands. Mechanical steel bearing anchors require expensive encapsulation to inhibit corrosion-related strand failure. Cost-cutting in new regions adopting unbonded PT technology has resulted in the use of low-quality encapsulation and execution methods. The steel anchors also result in premature strand fracture at steel wedges at strand strains between 1% to 2%. UHPC's superior mechanical and durability properties have the potential to provide an alternate and economical solution to address the above issues. Precast UHPC mechanical bearing anchors with UHPC wedges work well with fiber-reinforced polymer (FRP) prestressing strands and bars, but their wedge teeth are not tough enough to be used with steel prestressing strands. They are also not mass-manufacturing friendly and currently not developed for use with standard 12.7 mm steel prestressing strands.

Therefore, there exists a need in the art for UHPC bond anchors (UBA) for anchoring unbonded post-tensioned strands in building structures and also for design methods for composite UHPC-steel truss type long-span floor systems.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the invention to improve on or overcome the deficiencies in the art.

It is a further object, feature, and/or advantage of the invention to develop anchors using UHPC for unbonded post-tensioning that will provide a cost-effective and highly durable alternative to the encapsulated system, while also eliminating strand fracture at low strains when using traditional steel anchor-wedge assemblies.

According to some embodiments, an ultra-high-performance concrete (UHPC) bond anchor (UBA) is provided. The UBA replaces steel mechanical bearing anchors that are currently used in unbonded post-tensioned slabs. The UBA works on the principal of increased bond between the UHPC and the prestressing strand to anchor the strand in the concrete slab over a short length. To enhance the bond two new techniques have been developed—one, a new truncated conical device, and two, indenting the strand.

The mechanical bearing anchors anchor the strands by bearing on the concrete, whereas, the UBA anchors the strand through bond. The mechanical anchor is an independent part whereas the UBA becomes one with the concrete slab, as the UHPC is cast on site into the concrete slab. UBA anchors are economical and easy to install. Steel mechanical bearing anchors need additional protective plastic encapsulation over it to safeguard it against corrosion. In addition, additional tubes at the back of the anchor and a protective pocket former in front of the anchor, grease filled cap and a chloride free non-shrink grout is required for the same reason. UHPC exhibits ultra-high mechanical and durability properties. The UBA does not require any of these additional protective measures as UHPC is extremely durable allowing near to negligible chloride ingress.

According to some aspects of the present disclosure, a cast-in-place ultra-high-performance concrete bond anchor (UBA) includes a roughened steel strand, a cone surrounding the roughened steel strand, and a layer of ultra-high-performance concrete (UHPC) positioned between the roughened steel strand and the cone.

According to at least some of the aspects and/or embodiments disclosed, the cone comprises steel.

According to at least some of the aspects and/or embodiments disclosed, the cone comprises a plurality of grooves on an external portion of the cone.

According to at least some of the aspects and/or embodiments disclosed, the cone comprises a plurality of externally protruding ribs along the length of the cone.

According to at least some of the aspects and/or embodiments disclosed, the cone comprises a length of approximately 175 mm being tapered, and approximately 25 mm extending from the tapered section and having a substantially non-tapered diameter.

According to at least some of the aspects and/or embodiments disclosed, the thickness of the cone is approximately 3 mm.

According to at least some of the aspects and/or embodiments disclosed, the UBA further comprises at least one spout extending through a wall of the cone to allow the UHPC to be added to the interior of the cone.

According to at least some of the aspects and/or embodiments disclosed, the roughened steel strand comprises a plurality of indents along the length of the strand.

According to at least some of the aspects and/or embodiments disclosed, the strand is approximately 12.7 mm in diameter.

According to at least some of the aspects and/or embodiments disclosed, the UBA further comprises an external layer of UHPC external of the cone.

According to additional aspects of the disclosure, a method of prestressing concrete using a cast-in-place ultra-high-performance concrete bond anchor (UBA) comprises positioning steel strands in an area to be poured with concrete, creating a stressing end block-out form in the area, pouring concrete around the form in the area to create a concrete slab, stressing the strands, pouring ultra-high-performance concrete (UHPC) in the block out form, and releasing the stress on the strands.

According to at least some of the aspects and/or embodiments disclosed, the step of stressing the strands comprises connecting an external anchor to the strands at a location external of the concrete and block-out.

According to at least some of the aspects and/or embodiments disclosed, the step of releasing the stress on the strands comprises releasing the external anchor from the strands.

According to at least some of the aspects and/or embodiments disclosed, the step of stressing the strands comprises connecting a jack to the strands to stress the strands.

According to at least some of the aspects and/or embodiments disclosed, the method further comprises removing an external portion of the strands after the UHPC has cured and hardened.

According to at least some of the aspects and/or embodiments disclosed, the method further comprises waiting until the UHPC has gained a compressive strength of 100 MPa before releasing the stress on the strands.

According to at least some of the aspects and/or embodiments disclosed, the method further comprises roughening the steels strands; and surrounding the steel strands with UHPC and a tapered steel cone with grooves or ribs.

According to still additional aspects of the disclosure a method of forming a cast-in-place ultra-high-performance concrete bond anchor (UBA) comprises roughening a steel strand used in forming a concrete slab, surrounding at least a portion of the roughened steel strand with a cone, said cone being at least partially tapered along its longitudinal length and including grooves or ribs around the cone, and pouring ultra-high-performance concrete (UHPC) between the roughened steel strand and the cone.

According to at least some of the aspects and/or embodiments disclosed, the method further comprises pouring UHPC around the cone, UHPC and roughened strand to anchor the UBA in concrete.

According to at least some of the aspects and/or embodiments disclosed, the method further comprises stressing the roughened strands prior to pouring UHPC around the cone, UHPC and roughened strand to anchor the UBA in concrete.

According to at least some of the aspects and/or embodiments disclosed, a UHPC bond anchor such as that disclosed herein could be used in a bonded, pre-stress component.

According to at least some of the aspects and/or embodiments disclosed, a hybrid system could be used that includes both a UHPC bond anchor as disclosed herein and an unbonded anchor working together. The UBA could be used in precast prestressed members to shorten transfer lengths and limit surface cracking.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Several embodiments in which the invention can be practiced are illustrated and described in detail, wherein like reference characters represent like components throughout the several views. The drawings are presented for exemplary purposes and may not be to scale unless otherwise indicated.

FIGS. 20A-20H are photographs showing cracking in cores from UBA specimens 1-4 as disclosed in Example 1 of the disclosure.

FIGS. 21A-21B show views of a UBA with grooved confining steel device according to aspects of the disclosure.

Figure 1:
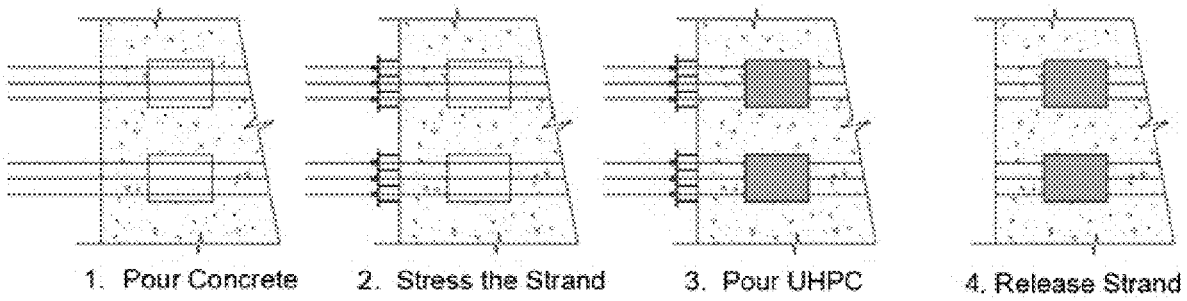
FIG. 1 is a depiction of general steps in UBA field application for anchoring unbonded strands.

An artisan of ordinary skill need not view, within isolated figure(s), the near infinite number of distinct permutations of features described in the following detailed description to facilitate an understanding of the invention.

DETAILED DESCRIPTION OF THE INVENTION

The present disclosure is not to be limited to that described herein. Mechanical, electrical, chemical, procedural, and/or other changes can be made without departing from the spirit and scope of the invention. No features shown or described are essential to permit basic operation of the invention unless otherwise indicated.

Glossary

Unless defined otherwise, all technical and scientific terms used above have the same meaning as commonly understood by one of ordinary skill in the art to which embodiments of the invention pertain.

The terms "a," "an," and "the" include both singular and plural referents.

The term "or" is synonymous with "and/or" and means any one member or combination of members of a particular list.

The terms "invention" or "invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "scope" of the invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

The U.S. Federal Highway Administration (FHWA) defines Ultra High-Performance Concrete as a cementitious composite material composed of an optimized gradation of granular constituents, a water-to-cementitious materials ratio less than 0.25, and a high percentage of discontinuous internal fiber reinforcement. The mechanical properties of UHPC include compressive strength greater than 150 MPa (21.7 ksi) and sustained post-cracking tensile strength greater than 5 MPa (0.72 ksi). UHPC has a discontinuous pore structure that reduces liquid ingress, thus significantly enhancing its durability as compared to conventional and high-performance concretes. Research has shown that the peak axial tensile strength of UHPC can range from 5 MPa to 11 MPa depending on the steel fiber type and content.

Table 1 lists the range of mechanical properties of UHPC.

TABLE 1-1

Range of UHPC Mechanical Properties [4]

| Property | Range |
|---|---|
| Compressive Strength | 140 to 200 MPa (20 to 30 ksi) |
| Tensile cracking strength | 6 to 10 MPa (0.9 to 1.5 ksi) |
| Modulus of Elasticity | 40 to 70 GPa (6,000 to 10,000 ksi) |
| Poisson's Ratio | 0.2 |
| Coefficient of Thermal Expansion | 10 to 15 millionths/° C. (5.5 to 8.5 millionths/° F.) |
| Creep coefficient[1] | 0.2 to 0.8 |
| Specific creep[1] | 6 to 45 millionths/MPa (0.04 to 0.30 millionths/psi) |
| Total shrinkage[2] | Up to 900 millionths |

As listed in Table 1-2, UHPC consists of a combination of Portland cement, fine sand, silica fume, high-range water-reducing admixture, steel fibers, and water. Sometimes smaller aggregates are also used apart from other chemical admixtures. The cement should have moderate fineness and a $C_3A$ content lower than 8 percent. The sand to cement ratio should be around 1.4 for a maximum grain size of 0.8 mm. Silica fume should be of low carbon content at 25% of the weight of cement, glass powder (1.7 μm) at 25% of the weight of cement, high range water reducing admixture, the water-cement ratio of about 0.22, and steel fibers in the range of 1.5% to 3.0% by volume.

TABLE 1-2

Typical composition of UHPC material [4]

| Materials | Kg/m$^3$ (lb/yd$^3$) | % by Weight |
|---|---|---|
| Cement | 712 (1,200) | 28.5 |
| Fine Sand | 1,020 (1,700) | 40.8 |
| Silica Fume | 231 (390) | 9.3 |
| Ground Quartz | 211 (355) | 8.4 |
| HRWR | 30.7 (51.8) | 1.2 |
| Accelerator | 30.0 (50.5) | 1.2 |
| Steel Fibers | 156 (263) | 6.2 |
| Water | 109 (184) | 4.4 |

The properties of UHPC provide for numerous uses, from industrial floor strengthening to civil structures, interior design, bank vaults, energy towers, as well as architectural and structural applications for building applications.

As noted, there are a number of issues with unbonded post-tensioning as it relates to concrete. In addition, UHPC has superior mechanical and durability as compared to normal concrete. Specifically, it exhibits high bond strength with steel prestressing strands, high capacity to take pre-compression due to its ultra-high compressive strength, shows post-peak ductility in tension, and high fracture energy. Due to UHPC's tight particle packing, it also exhibits extremely low chloride permeability, carbonation penetration, freeze-thaw resistance, salt-scaling resistance, and entrapped air content. Therefore, UHPC is an ideal candidate for consideration in the development of an alternative anchorage system for unbonded post-tensioned strands that is highly durable and better performing.

UHPC's high compressive strength, high elastic modulus, and low creep coefficient properties also make it an ideal candidate to explore its application to long-span floors post-tensioned floors. With UHPC, it is possible to apply extra prestressing, and design lighter and thinner floor slab and beam members, while having a better serviceability performance. This created an opportunity to explore a composite UHPC-steel truss floor system that could result in lighter, and cost-conscious buildings when compared to a conventional concrete post-tensioned floor system.

Therefore, as will be understood, at least some aspects and/or embodiments of the invention relate to anchors using UHPC for unbonded post-tensioning that will provide a cost-effective and highly durable alternative to the encapsulated system, while also eliminating strand fracture at low strains when using traditional steel anchor-wedge assemblies.

According to some embodiments, the invention includes a cast-in-place UHPC bond anchor (UBA). This mitigates, and possibly eliminates, the need for precasting UHPC anchors. According to some aspects and/or embodiments, systems, methods, and/or apparatus include the use of UHPC mix on-site to anchor prestressing strands by placing the material in a preformed pocket. This approach capitalizes on the superior bond characteristics between UHPC and the prestressing strand, and facilitate the creation of a dependable and durable UBA. The live end anchor of the UBA adopts the anchorage philosophy of transfer and development length used in precast prestressed concrete members. Using the UBA significantly shortens the transfer and development length compared to that required by current design standards for pretensioned strands. The development of this alternative anchorage system opens doors for new construction methodologies in slabs and beams in building structures, prestressed concrete industry, bridge engineering applications, repair and rehabilitation using external prestressing, cost-effective solutions for FRP strand and bar applications, and seismic applications in self-centering structural systems involving unbonded post-tensioning.

UHPC and prestressing complement each other very well. The ultra-high compressive strength of UHPC allows for high pre-compression to be put into it, resulting in more architecturally pleasing structural elements. Similarly, the high bond strength between UHPC and prestressing allows for innovation in structural design. The UBA is envisioned to be easily applicable to both banded and distributed tendons. FIG. 1 illustrates the general steps in the field application of the UBA, which generally include the following steps.

First, create a stressing end block-out in the slab. Locate the block-out such that it is approximately between 230 to 300 mm away from the slab edge. In the case of an edge-beam in the floor slab, the block-out can be placed immediately beyond the inside edge of the beam. This adequately protects the UBA from moisture penetration through the slab-edge. The outside surface of the block-outs should be provided with form-liners to create, roughness on the concrete surface. The sheathing on the strand is removed in the block-out region, and the grease covering is cleaned up thoroughly. The strand sheathing between the slab edge and the block-out can be left in place. Once the concrete is poured, and after it hardens, the block-out formwork can be removed.

After concrete gains sufficient strength, the strands are stressed and temporarily anchored using reusable anchors outside the slab-edge. UHPC is poured in the block-out. Once the UHPC gains a compressive strength of approximately 100 MPa, the temporary anchor can be released. The tail end of the strand can be cut substantially flush with the slab-edge using an abrasive cutter. A corrosion-resisting material like epoxy spray or galvanizing spray or red-oxide can be sprayed over the exposed end face of the strand. Note that the UHPC inside the UBA is encapsulating the strand. Beyond the UBA, the grease-filled sheathing is already protecting the unstressed portion of the strand. The corrosion resisting spray at the slab-edge is more than sufficient to protect corrosion in the strand to develop inwards into the concrete slab.

Accordingly, at least some aspects of the invention are directed towards the application of ultra-high-performance concrete (UHPC) in prestressed building floor systems. At least some embodiments are directed towards systems, methods, and/or apparatus to anchor unbonded post-tensioned strands in slabs using UHPC and to develop a composite UHPC-steel truss system for use in long-span floor systems in buildings.

According to aspects and/embodiments of the invention, a UHPC bond anchor (UBA) uses cast-in-place UHPC to anchor pretensioned 12.7 mm prestressing strands, thus easing the installation process and providing necessary encapsulation to the strand.

In unbonded post-tensioned slabs, the typical PT layout of a two-way slab comprises distributed strands along one direction and banded strands in the perpendicular direction. The distributed tendons are typically in groups of two or three strands spaced around 1000 mm on centers, whereas the banded tendons consist of about 15 strands in a group along the column gridline. The UBA is envisioned to be easily applicable in both situations. FIG. 1 illustrates the steps in implementing a UBA, the steps of which was previously disclosed herein in more detail. This requires creating block-outs near the stressing end and exposing the strand from its sheathing within the block-out. Once the concrete is poured, and it gains required strength, the strands are stressed and temporarily anchored. Thereafter, pour UHPC into the block-out and then release the strands once UHPC has gained strength. The tail end can then be cut using an abrasive cutter.

Figure 2:
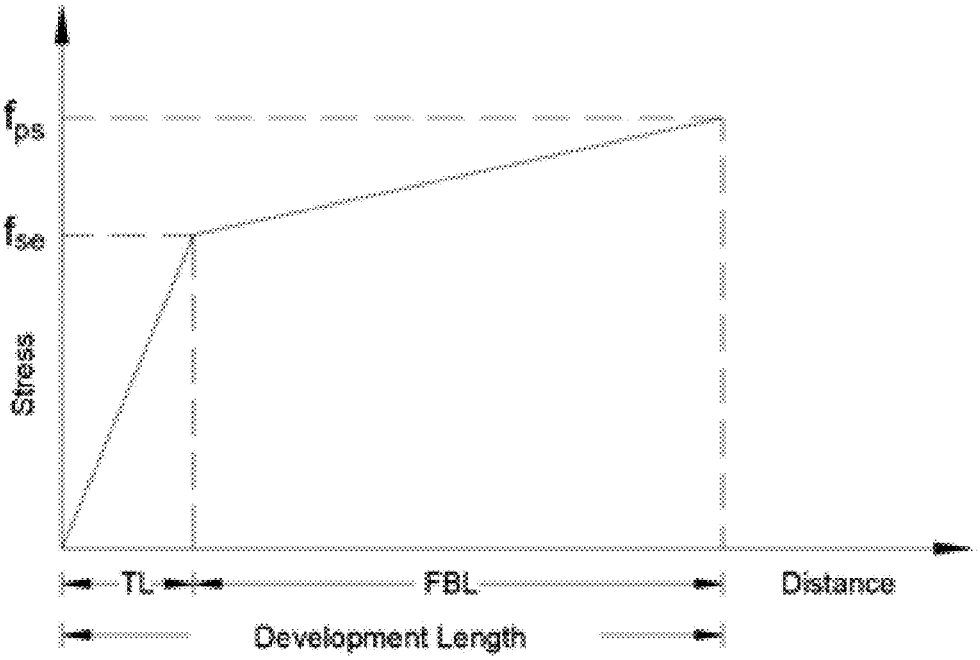
FIG. 2 is a schematic showing the transfer and development length of prestressing strand.

For a short UBA to be made possible, it may be desired to develop high bond stress between the UHPC and the prestressing strand. The anchor length required to transfer the effective prestress force from the strand, upon its release, to the concrete is called the transfer length (TL). In prestressed concrete members, an additional anchor length, called the flexural bond length (FBL), is used to develop the required nominal moment capacity of the member. As illustrated in FIG. 2, the total anchorage length is called the development length, which depends on the average bond stress at the interface of the UHPC and the prestressing strand. The terms fse and fps denote the effective prestressing stress and the tensile stress at the ultimate load in the strand, respectively. The FBL is typically higher than the transfer length and is dictated by the cracking around the strand at ultimate loads and inelastic strains in steel.

Figure 3:
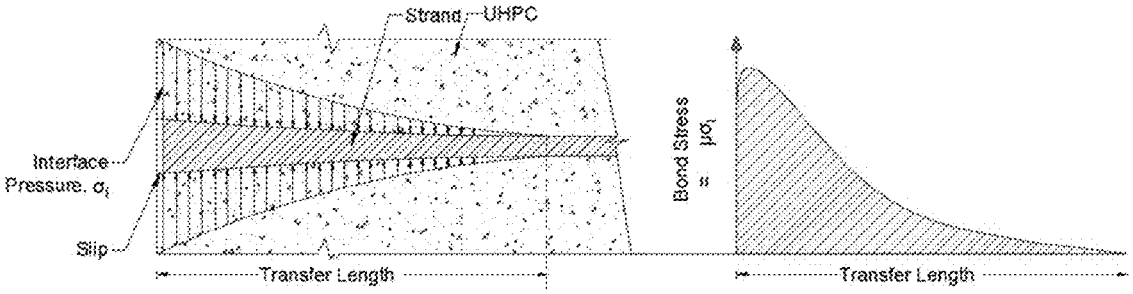
FIG. 3 are graphs showing bond stress distribution due to Hoyer effect.

There are three bond mechanisms active, when a prestressing strand is released—adhesion, mechanical interlock, and Hoyer effect. The adhesion is a result of the stickiness that develops when the concrete hardens against the strand. Adhesion is quickly lost at the onset of the strand slip and contributes negligibly towards the bond stress. The 'mechanical-interlock' is a special property exhibit by prestressing strands. The 12.7 mm and the 15.2 mm strands comprise of seven wires, six of which are wound around the center wire. The twisted shape of the strand locks the strand into the concrete and makes it difficult for the strand to be pulled-out. The strand diameter shrinks on pretensioning due to the Poisson's effect. Upon concreting and subsequent release of the prestressing strand, the strand tries to regain its original diameter. This results in high interface pressure ($\sigma i$) between the UHPC and the strand. The phenomenon is called Hoyer effect and is illustrated in FIG. 3. Logically, the higher the friction (μ) between the strand and the UHPC, the higher is the bond stress.

The average bond stress in the transfer length should be, in general, higher than that in the flexural bond length. The average bond stress in the TL ($u_{t,avg}$), and the FBL ($u_{b,avg}$) can be obtained from Eq. (3-1) and Eq. (3-2), respectively. The term $u_o$ and $A_{ps}$ represents the actual perimeter and the area of the prestressing strand, respectively.

$$u_{t,avg} = \frac{f_{se}A_{ps}}{u_o(TL)} \quad (0\text{-}1)$$

$$u_{b,avg} = \frac{(f_{ps} - f_{se})A_{ps}}{u_o(FBL)} \quad (0\text{-}2)$$

Figures 4A, 4B, 4C, 4D, 4E:
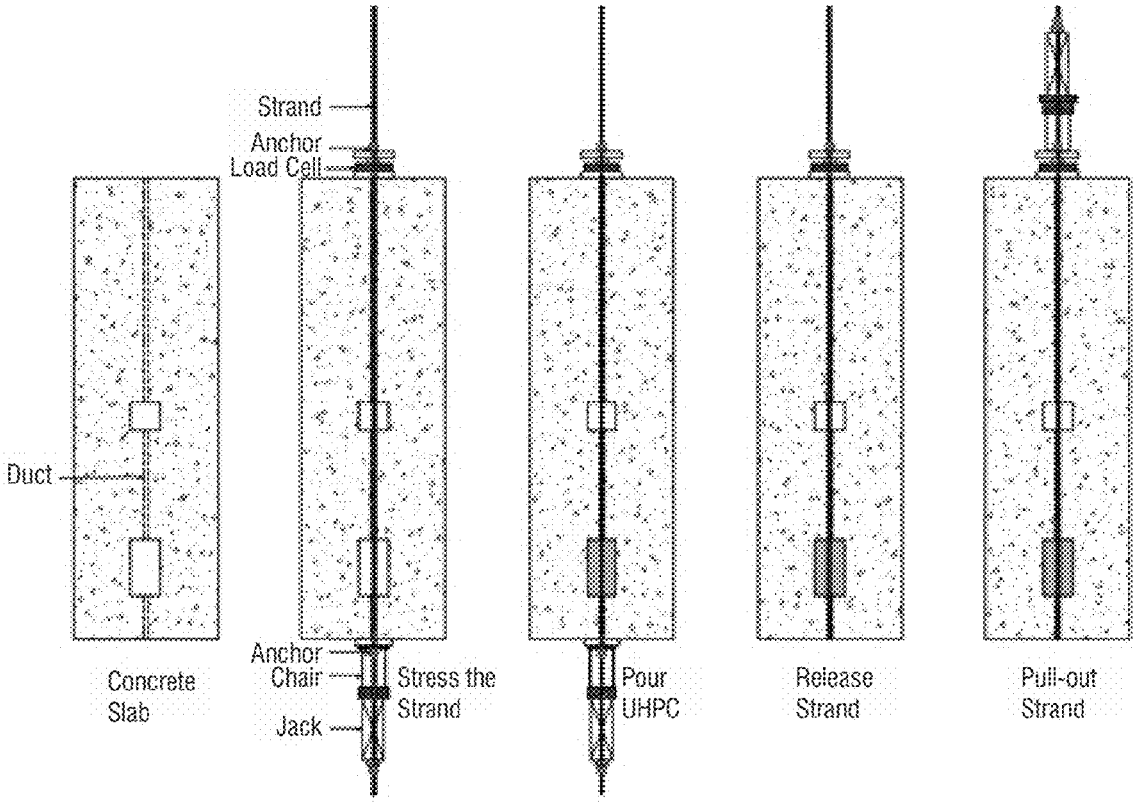
FIGS. 4A-4E are general steps followed for testing of the UBA according to aspects of the present disclosure.

To test the USA according to embodiments disclosed herein, steps were included and generally shown in FIG. 4. According to the steps, the slab specimens can be made of conventional concrete, having a cylinder compressive strength of M34.5 and a thickness of 150 mm to imitate a typical post-tensioned slab. A debonding circular plastic duct is placed at mid-depth of the slab to allow the strand to be threaded through it. Block-outs are placed at one or both ends of the specimen to pour UHPC.

The strand is first pretensioned and held in place with temporary steel anchors at the slab ends. UHPC is then poured into the block-out and allowed to set. Once the UHPC has gained at least 100 MPa strength in compression, the prestressing force is released suddenly, as is done at a construction site. If the strain in the unbonded portion of the strand remains unchanged, then the prestressing force transfer is said to have been achieved within the bonded length with UHPC. On further gain of UHPC strength, a pull-out test from the fixed end of the specimen is done to get the maximum force and the strain in the prestressing strand. The strand fails either by slip or wire fracture. The sudden release of the strand can be achieved by torching the strand at the stressing end using an oxyacetylene torch.

Example 1

To test the UBA according to aspects of the invention, phased testing was used. The first phase uses the possibility of anchoring the strand by just using UHPC surrounding the strand in conjunction with prestress release into the UHPC by means of torching the strand. Both sudden release and gradual release process can be used. According to one example, a total of five tests were run in Phase one, out of which two were also run with a short, thin cone confining a part of the UHPC. Observation and inferences from Phase 1 were used to establish the protocols for tests in Phase 2. The use of combinations of various confinement steel, roughened, and smooth strands were explored to increase the average bond stress and establish the best performing UBA. In all, four tests were carried out in Phase 2.

The UHPC used through experimental Phase 1 and 2 was limited to Lafarge Ductal® proprietary grey premix. Dramix® steel fibers from Bekaert® were used for the experimental work and were supplied by Lafarge. The steel fibers have a diameter of 0.175 mm, a length of 13 mm, and tensile strength of about 3000 MPa. The compressive strengths are test specific and noted along with the test phases in this example. Ultimate tensile strengths of UHPC were taken as 7.3 MPa and 11 MPa for 1% and 2% steel fiber content, respectively. The UHPC mix-design used for the tests is shown in Table 3-1.

TABLE 3-1

UHPC Mix Design

| Premix (Kgs/Cu.m) | Water (Kgs/Cu.m) | Super plasticizer (Kgs/Cu.m) | Steel fibers (2%) (Kgs/Cu.m) |
|---|---|---|---|
| 2195 | 117 | 30 | 156 |

The 12.7 mm diameter seven-wire prestressing strand used through the testing phase conformed to ASTM A416 specifications with minimum ultimate tensile strength, $f_{pu}$, of 1860 MPa. Material from the same coil was used throughout the experimentation. The mechanical properties of the strand are listed in Table 3-2.

TABLE 3-2

Elastic Modulus and Poisson's Ratio of Anchorage Materials

| Tensile Strength (kN) | Yield Strength (kN) | Elongation (%) | Area ($mm^2$) | Elastic Modulus (MPa) |
|---|---|---|---|---|
| 198.6 | 181.5 | 5.1 | 98.0 | 197,241 |

Phase 1 of Testing

Prior research on prestressed UHPC beams suggested that the transfer length of 12.7 mm prestressing strands in the range of 250 to 400 mm. A total of five tests were conducted as part of the Phase 1 series. Table 3-3 gives the test matrix with associated details. A 150 mm thick concrete slab is used for all specimens. This thickness provides a clear cover to the strand diameter ratio of 5.4, sufficient to prevent the splitting of UHPC. Secondly, the minimum thickness of an unbonded PT used in building construction is approximately 140 mm. There are two levels at which the testing should succeed in order for the UBA to anchor the unbonded PT strand. The first level is at the release of the strand from its temporary anchor, to successfully transfer the effective prestress force from the strand into the UHPC, and the second is during the pull-out tests where the strand needs to develop sufficient tensile force and ductility at ultimate load.

TABLE 0-5

Test Matrix for Phase 1

| | UBA Dimensions (mm) | | | | Release | $f'_c$ at Release | $f_{se}$ at Release |
|---|---|---|---|---|---|---|---|
| Specimen | b | h | L | Confinement | Type | (MPa) | (kN) |
| 1 | 150 | 150 | 610 | Not Provided | Sudden | 104 | 131 |
| 2 | 150 | 150 | 380 | Not Provided | Gradual | 112 | 134 |
| 3 | 150 | 150 | 380 | 18 ga. × 75 mm Steel Cone | Gradual | 135 | 120 |

TABLE 0-5-continued

| Test Matrix for Phase 1 | | | | | | | |
|---|---|---|---|---|---|---|---|
| | UBA Dimensions (mm) | | | | Release | $f'_c$ at Release | $f_{se}$ at Release |
| Specimen | b | h | L | Confinement | Type | (MPa) | (kN) |
| 4 | 150 | 150 | 380 | Not Provided | Sudden | 123 | 123 |
| 5 | 150 | 150 | 380 | 18 ga. × 75 mm Steel Cone | Sudden | 107 | 117 |

$f'_c$ is the cube compressive strength of UHPC at release; $f_{se}$ is the effective force in the strand prior to release.

Test #1 with Sudden Prestress Release

Figure 5A:
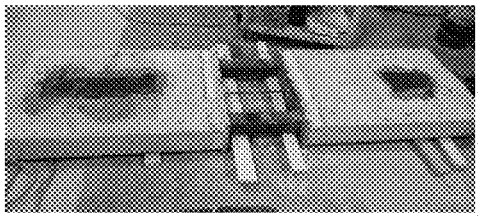
FIGS. 5A and 5B are a depiction of a set up for a test according to aspects of the disclosure.
Figure 5B:
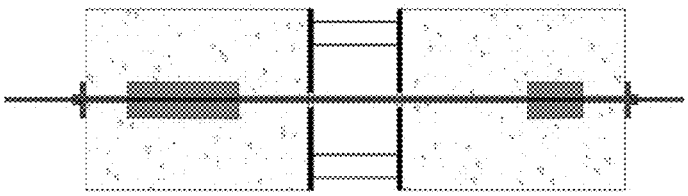
Figure 6B:
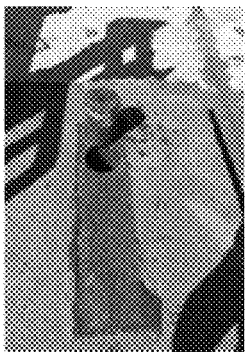
FIGS. 6A-6E are photographs of UHPC cracking in core.
Figure 6C:
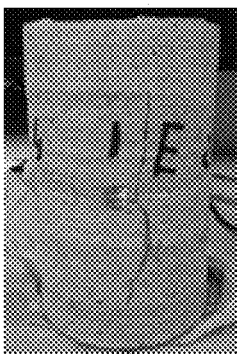
Figure 6D:
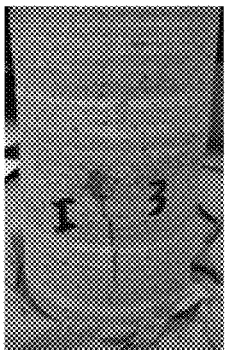
Figure 6E:
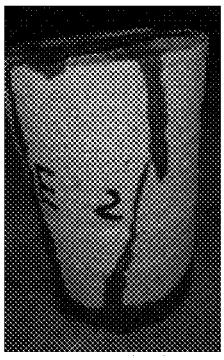
Figure 6F:
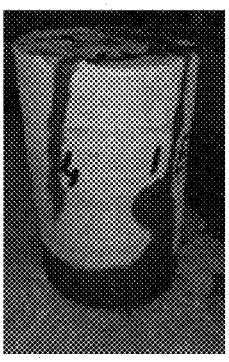

As illustrated in FIG. 5, two concrete blocks bearing against steel tubes formed the set-up for the first test. Each concrete block had a block-out for UHPC, but only the longer block-out was used for the UBA test. On prestressing the strand, the entire assembly acts like one. Strain gauges were attached to the strands inside the UBA to determine the prestress transfer. They were also attached to the unbonded strand between the concrete blocks. The length of the set-up between the outside edges of the concrete blocks was 2950 mm. The prestress was suddenly released into the UBA by torching the strand. The strain in the unbonded portion of the strand dropped 100%, and the assembly loosened up. This indicated that the UBA failed to anchor the strand and could not transfer the prestress force. Jacks were then placed in the middle of the assembly, and the two blocks were pushed apart. The pull-out load was just 80 kN, far below the minimum of 175 kN required by ACI 423-7.

To examine the cause of prestress transfer failure, a 100 mm diameter core was cut in the UBA. As illustrated in FIG. 6, large cracks in the UHPC were found starting from the strand and extending out towards the free edge of the UBA. These splitting cracks were nearly vertical along both the perpendicular directions. The high fracture energy of the UHPC could not resist the dynamic shock from the sudden release of the prestressing force. On the contrary, prestress beams generally see a 20% to 30% increase in transfer length. This was a new observation for unbonded PT slabs. Increasing the size of the UBA was not the preferred direction for economic reasons.

Tests #2 and 3 with Gradual Prestress Release

Figure 7A:
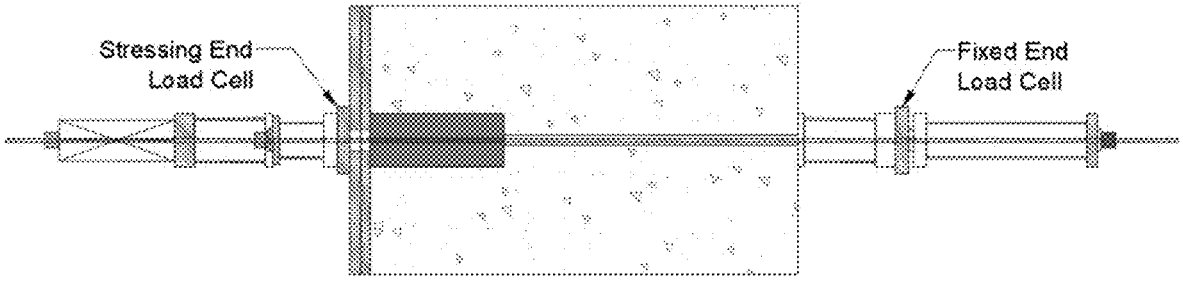
FIGS. 7A and 7B show depictions including an assembly for another test and load cell reading at prestress release, respectively, according to aspects of the disclosure.
Figure 7B:
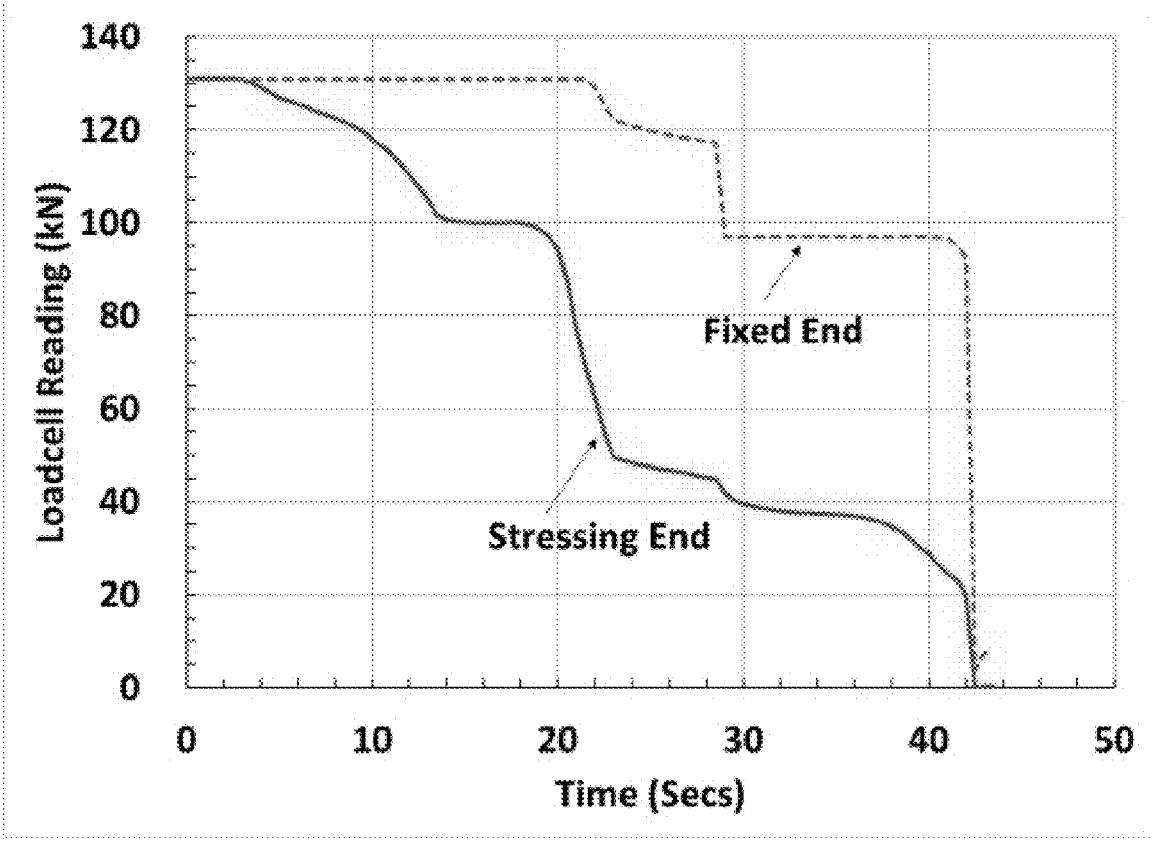

Test #2 and 3 were designed to evaluate if gradually releasing the strand can result in successfully transferring the effective prestress force into the UBA. A UBA length of 380 mm was selected. In Test #2, the strand was gradually released by slow torching the strand for 43 seconds near the stressing end. FIG. 7 illustrates the test specimen and the loadcell readings at the stressing and the fixed ends during the duration of the release. For successful load transfer to the UBA, the stressing end load cell reading should almost linearly drop to zero, while the fixed end load cell reading should maintain status-quo. The slow torching helped catch the load cell readings during the course of strand release. The prestress force again failed to transfer to the UHPC. The stepped reduction in the stressing end load cell at 20, 28, and 43 seconds are associated with the loss of prestressing wire from torching. It can be observed that the loss of the first two wires did not result in an equivalent load drop at the dead end. The rest of the prestressing wires were lost together and resulted in the overall failure of the UBA.

Figure 8A:
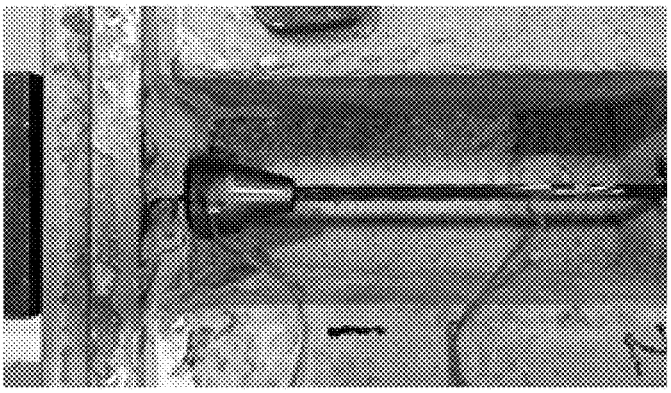
FIGS. 8A-8C are a depiction of another test of a cone with gradual release and graph showing timeline of the same.
Figure 8B:
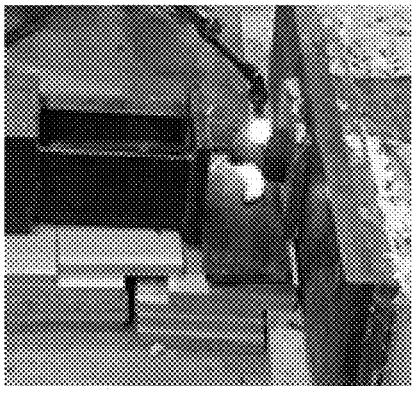
Figure 8C:
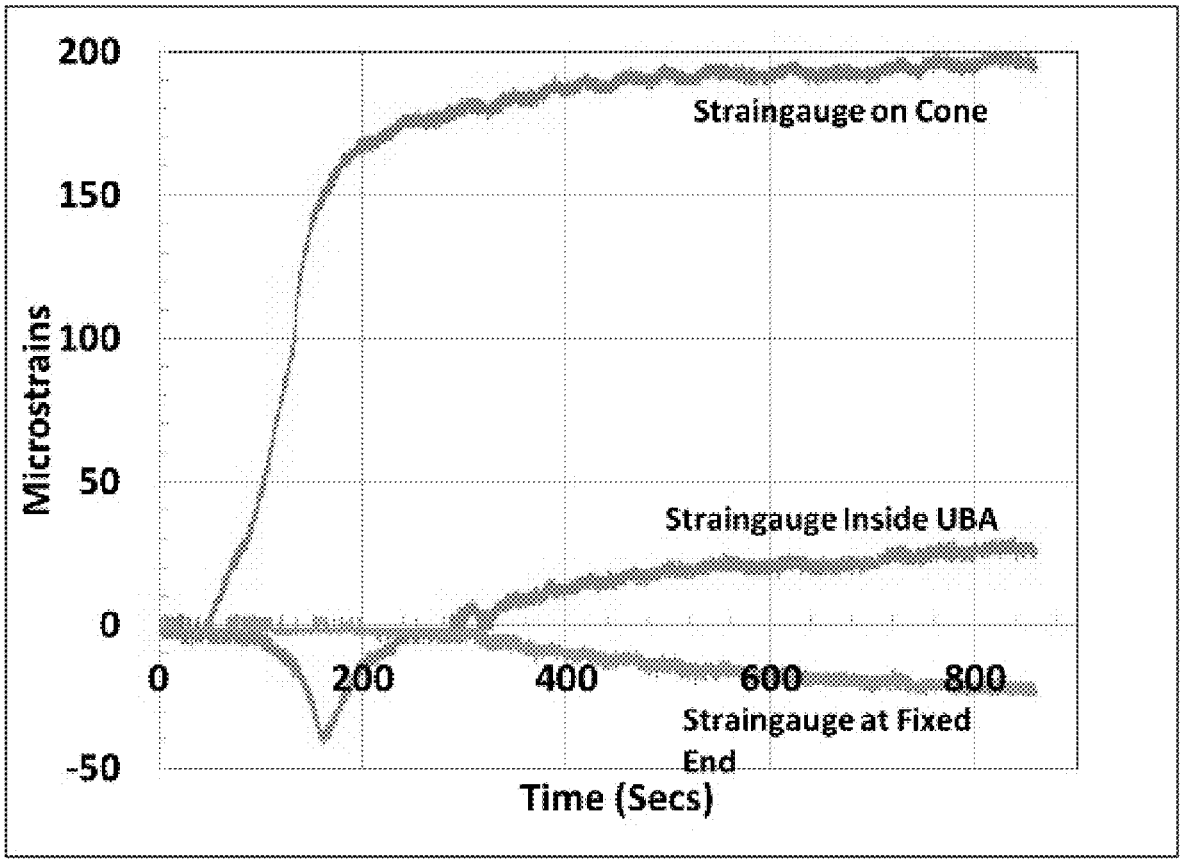

It can be inferred from Test #2 that torching is detrimental to the bond at the strand-UHPC interface, and hence further improvisation was done for Test #3. In order to prevent the individual wire losses during the gradual release, it was decided to slow heat the anchor barrel instead of the strand. It was also decided to add a conical-shaped steel element to confine a short length of the UHPC. A market procured thin truncated cone made with cold-rolled steel of 18 gauge thickness, 75 mm in length, narrow end diameter of 28.6 mm, and a wider end diameter of 65.1 mm was used to confining the UHPC at the stressing end in the UBA. FIG. 8 illustrates the test improvisation and the strain changes in the cone and the strand during the gradual prestress release. A 100% prestress transfer was achieved after 162 seconds of gradual release. The strain changes recorded at the unbonded and bonded region of the strand in the UBA show negligible stress change. The cone registered a 155 microstrain change corresponding to 31 MPa hoop stress. Further strain change after 162 seconds, as indicated in FIG. 8, relates to thermal strains due to heating of the anchor chuck for a long duration. Test #3 helped to conclude that in unbonded PT systems, it was possible to transfer the effective prestress force within a length of 380 mm.

Tests #4 and 5 with Sudden Prestress Release

Figure 9:
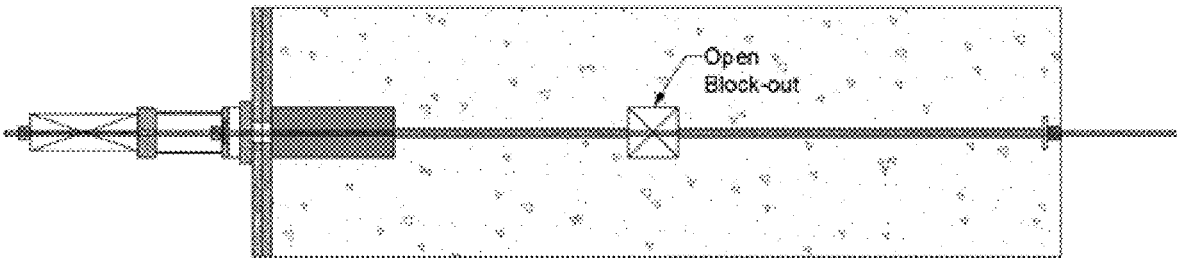
FIG. 9 is a depiction of an assembly for additional tests of the UBA according to aspects of the disclosure.

Two additional tests were performed. The previous test assemblies were put together with simple bearing contact between the concrete blocks and the steel tubes. There was the apprehension that contribution to the failures from sudden release could also be a result of this simple contact assembly. Two new specimens, as illustrated in FIG. 9, were built as full slabs with a 380 mm long UBA at their stressing end. A center block-out was added to connect strain-gauges to the unbonded strand.

Figure 10A:
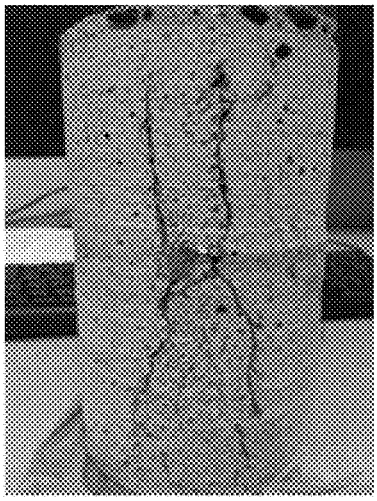
FIGS. 10A-10C are photographs showing cracks in UHPC from a test.
Figure 10B:
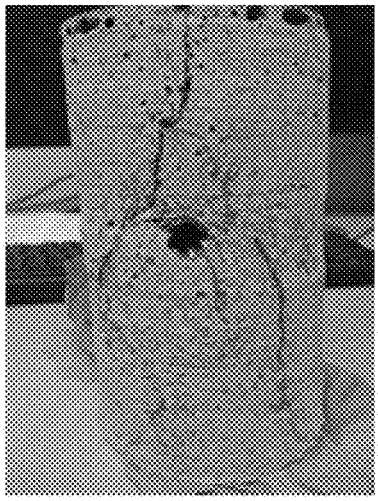
Figure 10C:
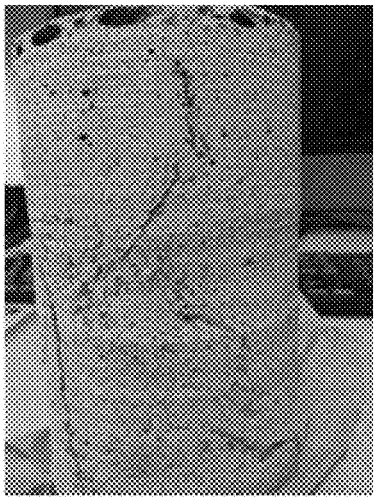
Figure 11A:
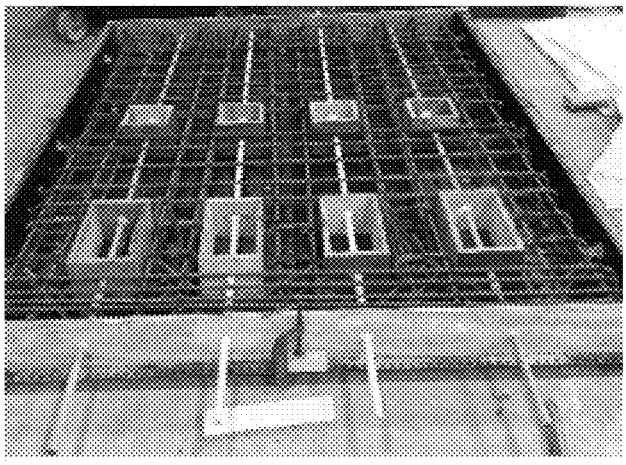
FIGS. 11A-11F show photographs of a phase 2 test, including 11(*a*) Reinforcing cage, 11(*b*) Test slab, and (c)-(f) Specimens 1 to 4 per Table 3-4.
Figure 11B:
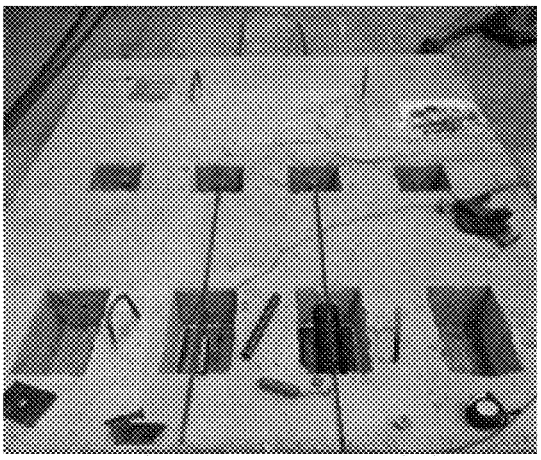
Figure 11C:
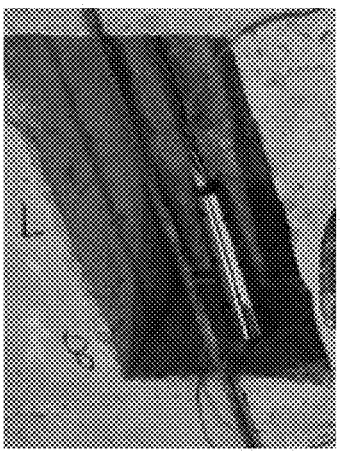
Figure 11D:
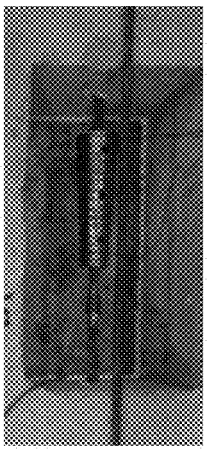
Figure 11E:
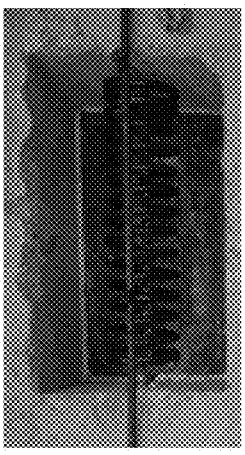
Figure 11F:
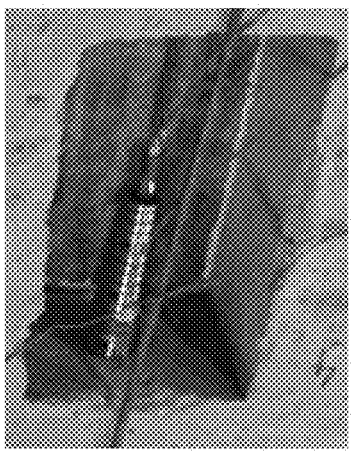

The UBA in Test #4 just had the UHPC, whereas the UBA in Test #5 also had the 18 ga. thin steel cone that was used in Test #3. The strand in both tests was released suddenly by the torching of the strand. The UBA's in both tests failed to transfer the prestress. From FIG. 10, it can be seen that the core taken from Test specimen #5 had major splitting cracks, similar to the core taken from Test #1.

Phase 2 of Testing

Four tests were planned for Phase 2. The purpose of tests in this phase included arresting splitting of the UHPC due to the sudden release of the strand, the ability to transfer the effective prestressing force, develop the ultimate tensile stress in the strand, and to get ductility in the strand. A new thick cone was designed for confining the UHPC. Two variants of the thick cone, one with exterior grooves and one with a smooth finish, were used. A commercially available spiral made with spring steel was also procured for confining the UHPC. A combination of steel confinement and strand roughening by indentation was used for the tests. The concrete slab was 1830×2440×150 mm in size. The size of the UBA was fixed to 190×345×150 mm, with a 2% fiber volume in the UHPC. Table 3-4 details the test matrix and the corresponding UHPC cube compressive strengths at the time of the prestress release and pull-out test, respectively.

TABLE 3-4

Test Matrix for Phase 2

| Specimen | Confinement | Strand | $f'_c$ at Release (MPa) | $f'_c$ at Pull-out (MPa) |
|---|---|---|---|---|
| 1 | Smooth Cone | Smooth | 104 | 163 |
| 2 | Grooved Cone | Indented | 112 | 143 |
| 3 | Spiral | Indented | 112 | 143 |
| 4 | Grooved Cone | Smooth | 104 | 163 |

FIG. 11 illustrates the formwork with the reinforcing cage, finished slab, and the block-outs with the cones and the spiral. Specimens 2 and 3 were poured with the same batch of UHPC and were stressed together. The prestressing strands in both specimens were released on the same day, one after the other. The pull-out tests on both specimens were also done on the same day, one after the other. A similar procedure was then followed for specimens 1 and 4. Strain gauges were placed at mid-length of the unbonded portion of the strand to calculate the transferred force after prestress release and read the strains during the pull-out tests. Strain gauges were also placed on the strand next to the steel cone within the UBA and on the steel cones in specimen 1 and 4.

Strand Roughening

Two of the four tests were done with intentionally roughened strands by indenting them. The purpose of the indentation was to increase the friction and develop high bond stress at the strand-UHPC interface. A laboratory indentation method was adopted instead of acquiring market available indented strands. Indentation is required only in the length of the UBA, where the strand bonds with the UHPC. Market available indented strands are at least 25 percent more expensive than standard smooth strands. The indentation process was carried out using the grips of a universal testing machine. A compressive force of 223 kN was applied on the grips having a length of 200 mm to teeth into the strand. The strand was twice rotated 120 degrees so as to have a 360 degree of indentation on the strands.

The average depth and spacing of the indentation were 0.44 mm and 1.85 mm, respectively. Due to the twist in the wires, the indentation followed a pattern, where the indentations were in a group of 20 indents. Their maximum and minimum width were 2.5 mm and 1.3 mm, respectively. The overlap between the groups in adjacent wires was 10 mm, and the pitch was 30 mm.

Concept of Steel Confinement Cone

Prior studies with stirrup type confinement concluded that confinement did not help reduce the transfer length. In contrast, circular steel confinement generates an inwards passive pressure on the release of the prestressing strand and improves the stress-strain characteristics of UHPC due to biaxial and triaxial confining effects. The confining pressure also improves the bond performance. A traditional steel barrel anchor works on the principle of confining the wedges, resisting the hoop stresses, and transferring the prestressing force axially through end bearing to the concrete. The short steel wedges holding the strand, fit themselves into the conical housing of the barrel and cannot slip out of the barrel.

Figure 12A:
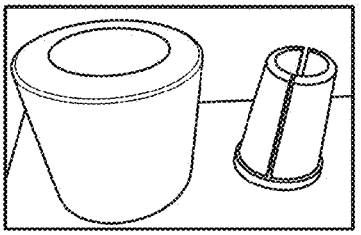
FIGS. 12A-12C shows views of (a) a barrel anchor, (b) a grooved cone, and (c) a smooth cone according to aspects of the disclosure.
Figure 12B:
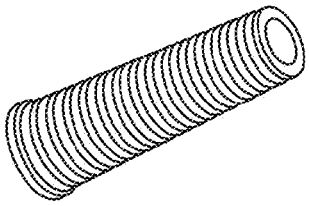
Figure 12C:
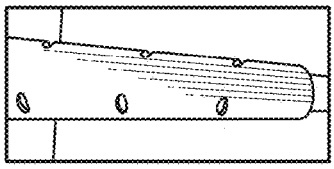

In the UBA concept, the UHPC surrounds the strand, and so the bond length required is longer than the length of a steel wedge. If the steel wedges are replaced by UHPC, an elongated barrel with a conical housing can act as a confining device. The prestressing force is transferred from the strand to the UHPC and from the UHPC to the steel cone through the surface to surface interface bond. The prestressing force in the cone transfers this force to the surrounding concrete or UHPC through the bond or bearing of the external surface of the cone. The end bearing of the cone is not relied upon for force transfer to concrete. The barrel weight can be minimized by keeping the cone's thickness consistent through its length. As shown in FIG. 12, the resulting shape of the barrel is a truncated cone with a conical housing to accommodate the UHPC and the strand. For Phase 2 testing, one cone with a smooth external finish was prepared; the other cones have grooves on their external surface for better bonding and bearing with surrounding concrete or UHPC.

Preliminary Design of the UBA Steel Cone

Figure 13:
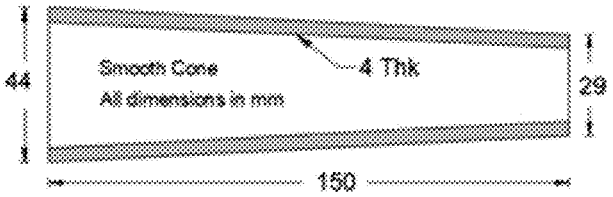
FIG. 13 is a depiction showing dimensions of a smooth cone.

Machined steel cones were prepared to conform to AISI 1045 with minimum yield and ultimate tensile strength of 310 MPa and 565 MPa, respectively. The material has an elongation of 16% in 50 mm. FIG. 13 illustrates the dimensions of the smooth cone with a length and a wall thickness of 150 mm and 4 mm, respectively. The wall thickness was increased from 4 to 6 mm to create the grooved cone. Then, semi-circular grooves having a 2 mm radius were cut at 10 mm on centers along the cone length.

Figure 14:
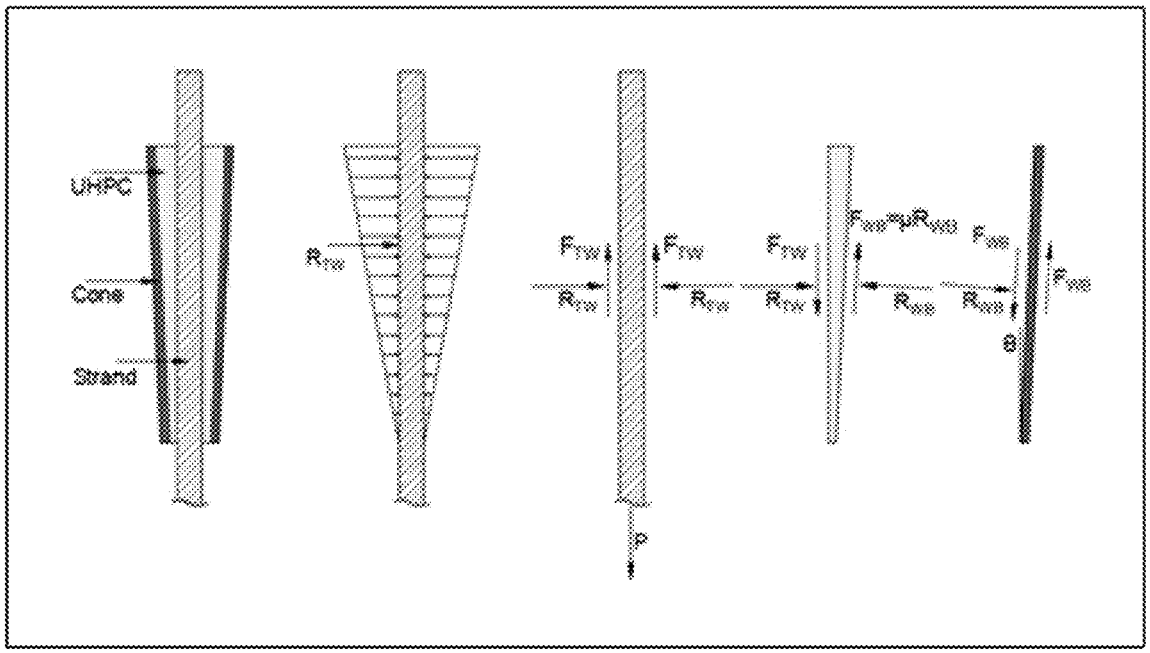
FIG. 14 shows a simplified static analysis of a UBA cone according to aspects of the disclosure.

For this preliminary design, it was assumed that the effective prestress is fully transferred in 150 mm, the coefficient of friction (μ) between the UHPC and the cone is 0.5. It was also assumed that UHPC does not crush under radial compression and that the UHPC does not resist any hoop tension. The simple static model approach, per FIG. 14, is used for the preliminary design of the cone. An effective prestress force ($F_{pe}$) equal to 135 kN, is taken as the design force. The cone angle (θ) is taken equal to 2.86°. The interface force, $R_{WB}$, given by Eq. (3-4), is equal to 246 kN. The thin cylinder theory is then used to determine the hoop stresses in the cone. The radius to the mid-thickness of the cone at its broader end is 20 mm, and the corresponding interface pressure ($P_i$), from Eq. (3-5), is equal to 26.1 MPa. The hoop stress as calculated from Eq. (3-6) is equal to 130 MPa, which is less than the yield strength of the steel cone.

$$R_{WB} = \frac{F_{pe}}{\mu\cos\theta + \sin\theta} \tag{0-3}$$

$$P_i = \frac{R_{WB}}{0.5(2\pi r)l_c} \tag{0-4}$$

$$\sigma_{WB} = \frac{P_i r}{t} \tag{0-5}$$

Spiral Confinement

Figure 15:
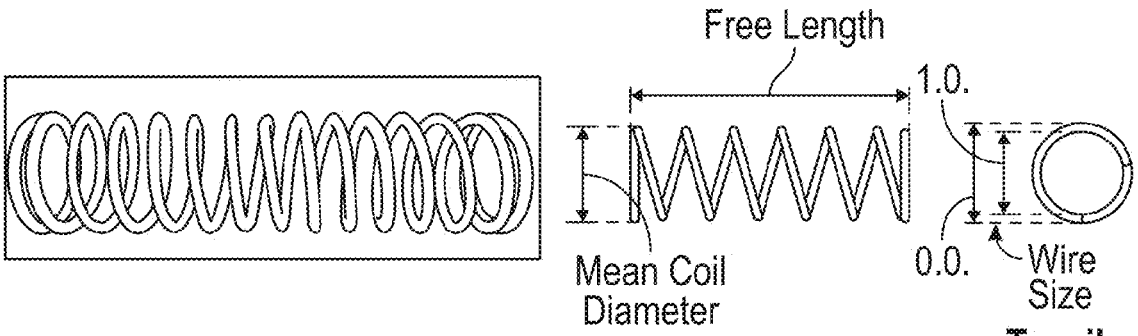
FIG. 15 shows views of a spiral confinement with dimensions and properties.

An alternate spiral reinforcement for confining the UHPC was also considered. A high tensile strength spring wire spiral was procured and tested with an indented strand for prestress transfer and strand development. FIG. 15 illustrates the spiral made with oil tempered spring steel.

The lateral pressure taking capacity ($f_l$) of the spiral can be given by Eq. (3-7) and is higher than that exerted on the steel cone from calculations in the previous section. Based on this argument and the spiral being twice the length of the cone, the spiral is expected to perform better than the steel cone.

$$f_l = \frac{2f_yA_b}{Sd_s} = \frac{2(930)(\frac{\pi}{4}(8.7)^2)}{23.2(80.2-8.7)} = 66.7MPa \tag{0-6}$$

Test Results, Observations, and Inferences

Figure 16:
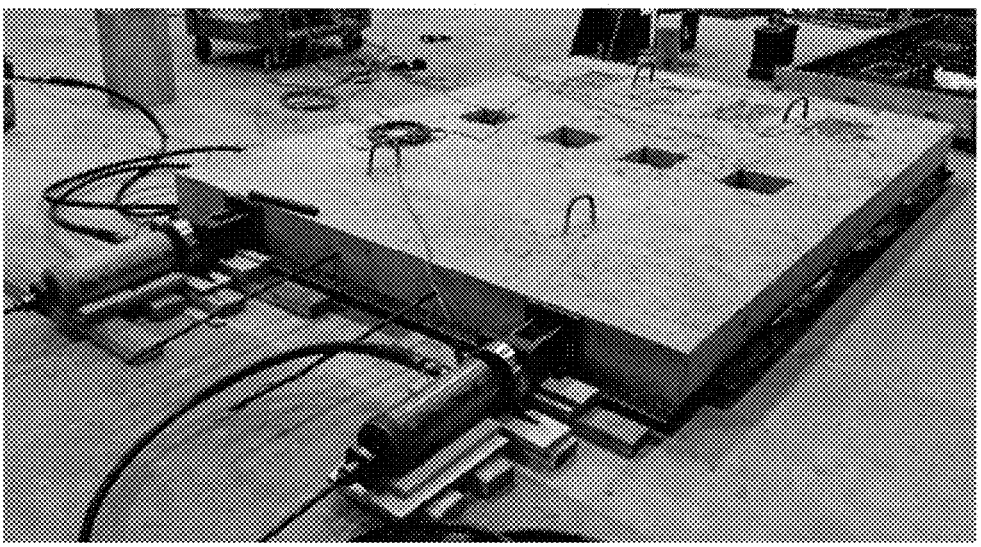
FIG. 16 is a photograph of a phase 2 pull-out test set-up.
Figure 17A:
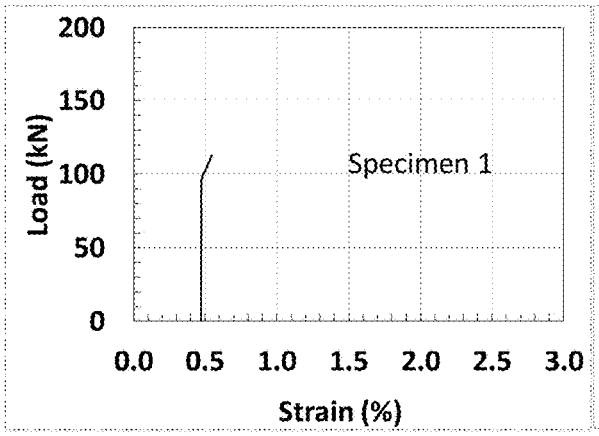
FIGS. 17A-17B are graphs showing specimen 1 and 2—Phase 2 pull-out load vs strain.
Figure 17B:
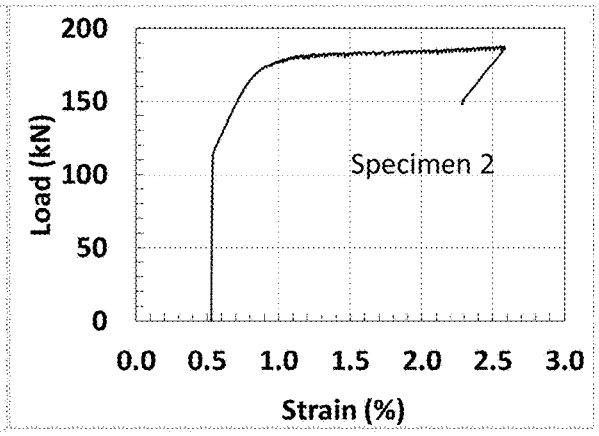
Figure 18A:
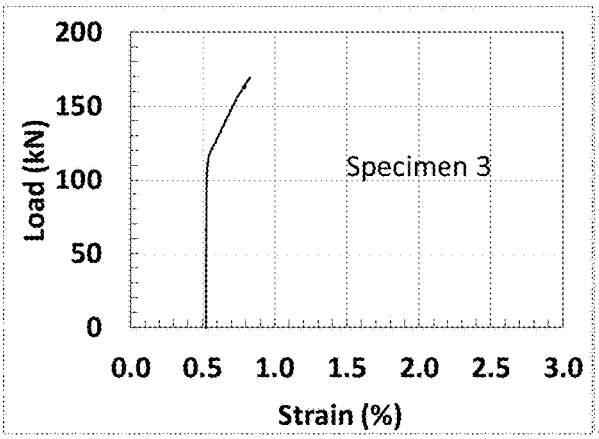
FIGS. 18A-18B are graphs showing specimen 3 and 4—Phase 2 pull-out load vs strain.
Figure 18B:
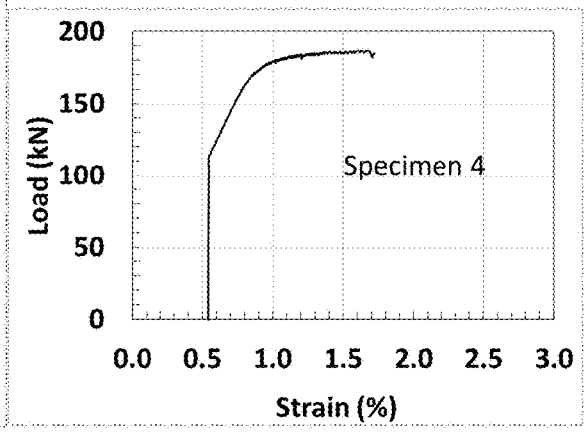
Figure 19A:
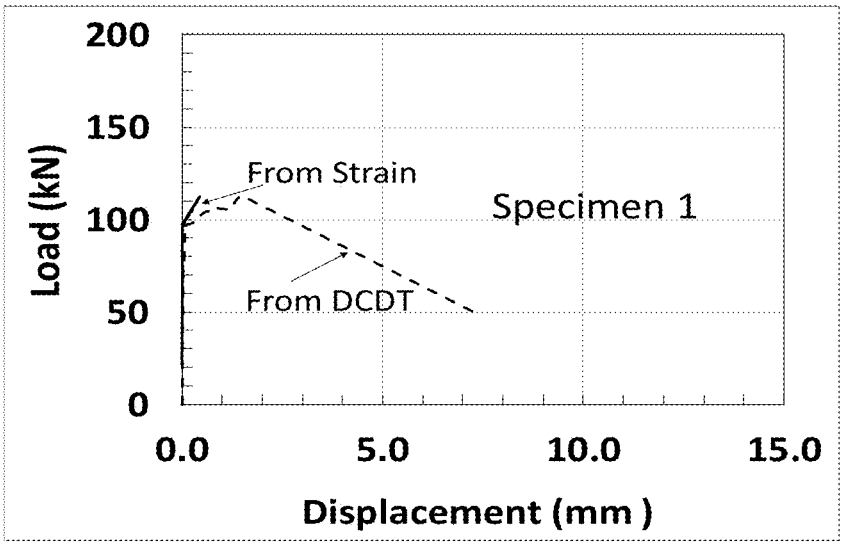
FIGS. 19A-19D are graphs showing Phase 2 load vs. displacement during the pull-out test.
Figure 19B:
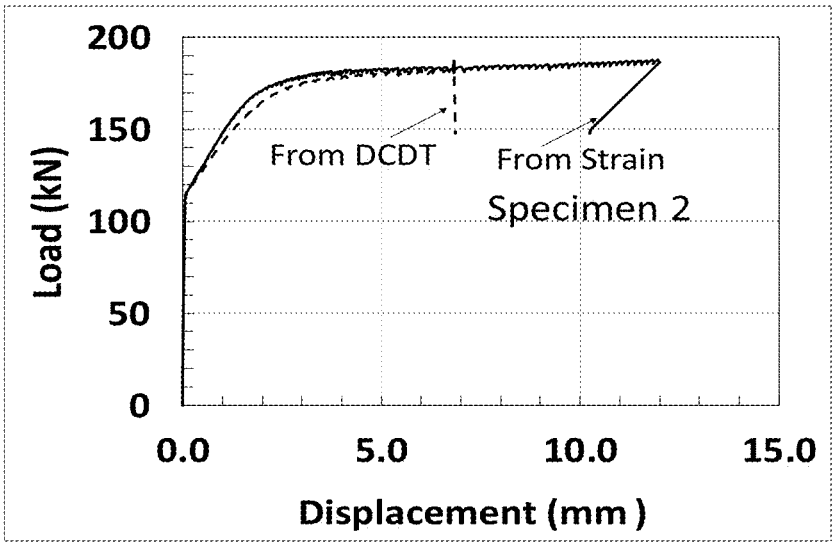
Figure 19C:
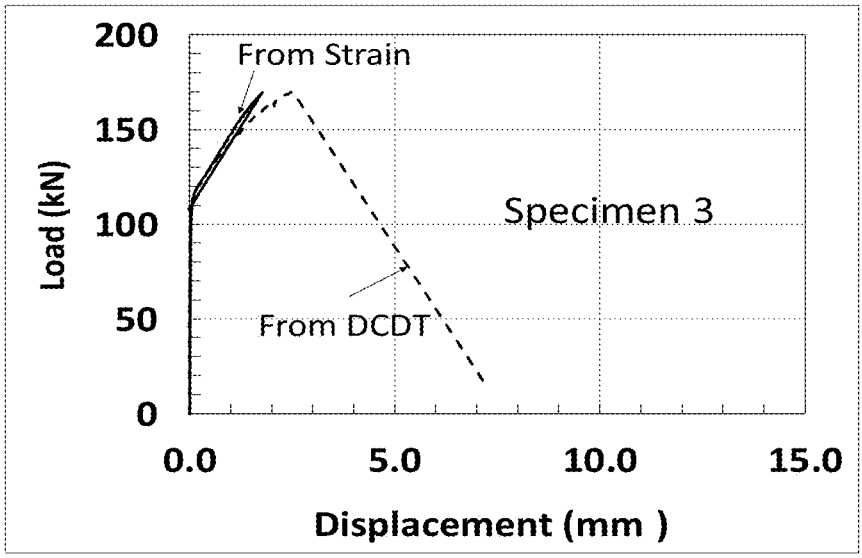
Figure 19D:
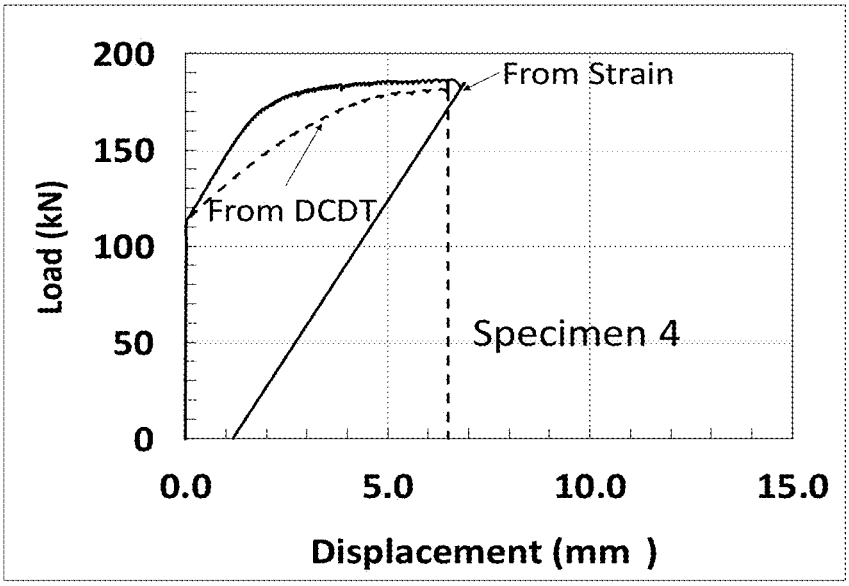

The force and corresponding strain in the unbonded region of the strand at various stages of the test are detailed in Table 3-5. The strands were pulled to about 147 kN at the start of the test, but due to the short strand length, the seating losses were high. During the pull-out tests, Specimen 2 performed the best, and the strand fractured at 2.6% strain. The strands in specimens 1, 3, and 4 slipped suddenly and re-locked themselves again in the UHPC. The re-locking can also be attributed to the Hoyer effect. As the strand slips and loses force, it tries to regain its full diameter and locks against the UHPC. The indentation in the strands, as well as the mechanical interlocking due to stranding of the wires, also help with the re-locking mechanism. The pull-out arrangement is illustrated in FIG. 16. A comparison of the pull-out force vs. strain graphs in FIG. 17 and FIG. 18 clearly illustrates that Specimen 2 performed the best, and Specimen 1 had the weakest performance.

TABLE 0-7

Phase 2 Test Results - Force and Strain in Prestressing Strand

| | Specimen 1 | | Specimen 2 | | Specimen 3 | | Specimen 4 | |
|---|---|---|---|---|---|---|---|---|
| Test Stage | Force kN | μStrain mm/mm | Force kN | μStrain mm/mm | Force kN | μStrain mm/mm | Force kN | μStrain mm/mm |
| Before Seating | 146.6 | 7348 | 147.0 | 7035 | 147.0 | 7073 | 146.6 | 7272 |
| After Seating | 112.1 | 5620 | 117.4 | 5621 | 113.8 | 5476 | 116.0 | 5755 |
| Before Release | 104.9 | 5257 | 111.6 | 5341 | 110.2 | 5302 | 110.0 | 5455 |
| After Release | 94.5 | 4736 | 111.6 | 5334 | 110.2 | 5305 | 109.3 | 5424 |
| Before Pullout | 94.5 | 4736 | 110.7 | 5296 | 109.4 | 5263 | 109.3 | 5424 |
| Max at Pullout 1 | 112.7 | 5504 | 188.0 | 25775 | 169.7 | 8229 | 185.0 | 17249 |
| Residual 1 | 49.0 | 2267 | 150.0 | 22892 | 15.0 | 612 | 0.3 | 7441 |
| Max at Pullout 2 | 109.2 | 5124 | — | — | 131.5 | 6329 | 123.8 | 13508 |
| Residual 2 | 47.4 | 2002 | — | — | 40.0 | 1812 | 22.8 | 8435 |
| Max at Pullout 3 | 111.7 | 5063 | — | — | 142.5 | 6677 | — | — |
| Residual 3 | 41.4 | 1568 | — | — | 27.5 | — | — | — |
| Transfer % | 90% | | 100% | | 100% | | 99.4% | |
| Development | Fail | | Success | | Fail | | Success | |
| Failure Type | Slip | | Fracture | | Slip | | Slip | |
| Max. Strain % | 0.55% | | 2.6% | | 0.82% | | 1.73% | |

Strain gauges were also placed inside the UBA just beyond the steel cone in specimens 1, 2, and 4. The purpose was to check for the transfer force just beyond the cones. The strain gauge in Specimen 1 was lost due to the sudden prestress release, which is an indication of the high dynamic shock experienced by the UBA and its poor performance. The strain gauges in Specimen 2 and 4 recorded 100% and 69% force transfer, respectively, just beyond the grooved cone. This indicates that with smooth strands, it is not possible to transfer the full effective force within the 150 mm long grooved cone. Specimen 4 did record a near 100% effective prestress force transfer within the UBA length. It can also be inferred that the grooved cones lock themselves up in the surrounding UHPC and appear to contain the dynamic shock from the sudden release of prestressing force.

Displacement transducers (DCDT) were placed inside the small block-outs near the center of the slab during the pull-out tests. The unbonded strand length between the inside edge of the UBA and the DCDT location was 584 mm, and hence the displacement recorded by the DCDT is inclusive strand elongation in that length. FIG. 19 illustrates the displacements from the DCDT and the strand elongation reverse calculated from the increment in strand strain during the pull-out test. The difference between the two displacements at any given load gives the slip in the strand. The data from Specimen 1 indicate small, but abrupt slips followed by a significant slip associated with a load drop and are indicative of bond damage leading to the early failure of the UBA. The data from Specimen 2 show negligible slip. The DCDT reaches its maximum stroke of 6.5 mm, but the strand continues to elongate until fracture. In Specimen 3, small but uniformly increasing slip starts at a load of about 150 kN, followed by a sudden slip of 4 mm associated with load drop from the peak load of 165 kN. The data from Specimen 4 indicates a smooth slip increase until the displacement reaches its maximum value of 6.5 mm. This is followed by a sudden slip associated with a full load drop from a peak load of 185 kN. FIG. 20 illustrates cracking in UHPC observed from the 100 mm diameter cores cut from the Phase 2 UBA specimens. The cores were located close to the outer edge of the UBA. The core for Specimen 3 was cut off-center in the UHPC to avoid the high tensile spring, so this core comprises of half UHPC and half concrete. Cracks were observed in the UHPC both inside and outside the cones in Specimens 1, 2, and 4, but cracking was not observed in Specimen 3 with the spiral confinement. The UHPC in Specimen 1 was heavily damaged inside the cone. The vicinity of the narrow end of the cone also shows major cracks in the UHPC. The failure of this smooth cone can most definitely be attributed to the damage of the bond inside the cone. Large cracks can be observed in Specimens 2 and 4 outside the cone region, but they do not continue inside the cone.

The grooves in the cone appear to hold the cone in position by absorbing the dynamic shock. They safeguard the UHPC bond inside the cone. The good mechanical performance of the cone can be attributed to the grooves. The core taken from specimen 2 does not tell anything on UHPC cracking inside the spiral, but the UHPC outside the spiral appears uncracked.

Conclusions—Example 1

Accordingly, from the Example and tests associated with the same, some conclusions related to Example 1 can be as follows. The sudden release of the prestressing force by the torching of the strand into a UBA without confining steel results in splitting cracks in the surrounding UHPC and total bond damage resulting in no prestress transfer and thus, total loss of stress in the strand. A UBA length up to 610 mm was tested but failed to anchor the strand. The gradual release of the prestressing force by the torching of the strand into a UBA without confining steel also fails to anchor the strand. Breaking of the individual wires results in consecutive bond damage at the UHPC-strand interface. If the prestressing wires are not cut during the slow release process, it does not damage the strand-UHPC bond inside the UBA. Use of a full-length spiral reinforcing inside the UBA is capable of successfully arresting cracks in the UHPC resulting from a sudden prestress release procedure by the torching of the strand. A combination of intentional strand indentation and a thick confining cone with external grooves inside the UBA can successfully anchor the unbonded strand during prestress transfer as well as at ultimate loads with sufficient ductility. Smooth confining cones should be avoided in the UBA when a sudden prestress release method by the torching of the strand is used. The narrow-end face of the cone is not sufficient for bearing against UHPC. The slip of cone against the surrounding exterior UHPC causes sufficient bond damage and renders it ineffective to anchor the unbonded PT strand.

From the tests, it can be concluded that the combination of the 150 mm long grooved cone and the indented strand in a 190×345×150 mm UHPC block with 2% steel fibers performed satisfactorily in anchoring an unbonded PT strand, although cracks were observed surrounding the cone. This combination can be taken further to develop the final version of the UBA. The current cone is machined, and the UHPC quantity per anchor is high. This impacts the overall economy of the product. Instead, steel castings will be highly economical. The current set of testing provides a viable direction for further analysis, additional tests, and development of a cone casting for its technical and economic viability.

According to still additional embodiments and/or aspects of the disclosure and/or invention, a new anchor using ultra high-performance concrete (UHPC) has been developed to anchor unbonded strands in post-tensioned slabs. The 'UHPC Bond Anchor' (UBA) is engineered to resolve the issue of premature strand failure at low strains that occur with industry-standard mechanical anchors. It also provides a cost-effective and highly durable alternative to encapsulated mechanical anchors. The UBA is cast-in-place and utilizes the bond mechanism between the strand and the UHPC to anchor the strand into the concrete slab. Exemplary design features of the UBA include strand roughening at the anchorage location, replacing steel wedges with wet UHPC around the pretensioned strand, confining the UHPC using an annular conical steel device, and protecting the device and the additional exposed strand beyond the device by surrounding it with UHPC. UHPC exhibits significantly superior mechanical and durability properties compared to conventional concrete. UHPC protects the strand against corrosion, and it can endure high radial compressive stress without crushing. Upon the release of the prestressing strand, the combination of the roughened strands and the confining device generates high normal pressure at the strand-UHPC interface resulting in high average bond stress. The long length of the confining device and its shallow angle mitigates premature strand fracture at low strains. The shape of the cone also improves anchorage behavior at ultimate loads, and the closely spaced ribs on its external surface bear against UHPC to transfer the prestressing force. Independent theoretical and numerical analysis on the UBA indicate that it could safely anchor an approximate 12.7 mm prestressing strand upon its release. It also indicated that the UBA remained elastic upon prestress release with hoop tension in the cone limited to within 80 MPa and the radial compression in the UHPC limited to within 40 MPa. According to initial research and testing, it has been found that the UBA of size 75×75×300 mm with 0.5 percent steel fiber content in the UHPC can safely anchor the 12.7 mm unbonded prestressing strand. The UBA can transfer 134 kN force into the concrete slab at prestress release without the need for supplementary confinement or bursting reinforcement and can develop a 196 kN of the tension force in the strand with adequate ductility during pull-out tests.

As is known, existing anchors for use with UHPC have issues. Therefore, it is an object, feature, and/or advantage of aspects of the invention disclosed herein to use uses the benefits of UHPC to provide a reasonably simple to execute and cost-effective solution to the above-mentioned issues, thus promising to deliver a high performing and durable unbonded post-tension system for building slabs.

It is desirable that a UHPC solution for anchoring should take care of both the performance as well as the durability requirements, should be easy to execute, and be cost-effective, all these without the need for any supplementary encapsulation or specialized execution method. As noted in the following example, it has been shown that cast-in-place (CIP) UHPC on site can anchor the unbonded post-tension strand into the concrete slab. This can be done in a number of ways, including, for example, to use the high strand-UHPC bond to anchor the strand in the concrete member, and also to protect the strand by surrounding it with UHPC. This may be referred to as the UHPC Bond Anchor (UBA), which is shown in FIG. 21. It has been found that to create a short UBA, high average bond stress is preferred, which can be developed by intentionally roughening the strands in the bond region. In addition, it has been found that a confining steel device is preferred for part of the UBA length to take hoop stresses and contain UHPC cracking. The UHPC inside the cone substantially surrounds the strand and replaces the wedge, whereas the cone acts as an elongated steel barrel. The length beyond the cone helps with the development of the ultimate tensile strength of the strand.

Example 2

According to preliminary testing for a UBA, it is suggested that an unbonded prestressing strand can be anchored by intentionally roughening the strand and surrounding it with a thick steel cone confined UHPC device. The UBA, as tested, had dimensions of 190×150×345 mm. The machined steel cone was 6 mm thick×150 mm long with grooves of 2 mm radius spaced at 10 mm on centers. The UHPC had 2% steel fiber content by volume, and the total bond length equaled the UBA length. This UBA still showed signs of visible cracking outside of the cone. Therefore, in the present example, it was desired to create a short, functional, and economical UBA that satisfies the static testing performance criteria for mono-strand anchors used with unbonded post-tensioning. Specific objectives included reducing steel fiber content, reducing UHPC quantity, reducing steel cone cost, eliminating major cracks surrounding the steel cone, with the ability to closely space the UBA's increase the effective prestressing force taking capacity of the UBA at prestress release to 134 kN, and exceed 2% strain in the strand at failure load. Before starting the experimental tests, a new cone was designed, and the UBA was analyzed for transfer length determination using theoretical as well as numerical methods. Bond tests on non-pretensioned roughened and smooth strands were also carried out to assess the average bond stress in the absence of Hoyer effect. Tension tests were also carried out on roughened strand samples to assess their ductility. The analysis and design of the UBA are provided, followed by the experimental tests and a summary of the results.

Working Concept of the UHPC Bond Anchor

The UBA is a cast-in-place anchor that relies on the bond at the strand-UHPC interface. Higher the average bond stress, the shorter will be the size of the UBA. The critical components of a functional UBA are the UHPC, the roughness of the strand, the confining conical steel device, and sudden prestress release mechanism. Roughening the strand increases the frictional coefficient of the strand. The confining device increases the strand-UHPC interface normal pressure upon prestress release, and thus, in combination with the high frictional coefficient of the strand, results in high average bond stress. An appropriate sudden release mechanism of the prestressing strand ensures against slip failure of the anchor.

As illustrated in previously discussed FIG. 1, a block-out is provided at the stressing end to pour the UHPC on site. The confining device is then placed inside the block-out, and the strand threaded through it. It is evident that the sheathing of the strand should be removed within the block-out, so as to allow for bonding after UHPC is poured. It is also evident that the UHPC should not be poured into the block-out before the strand is stressed; else, it may not be possible to stress the strand. The exposed strand inside the UBA should be roughened to the desired specifications. It is preferred that any grease on the strand be removed. The strand is tensioned to around 80 percent of its ultimate tensile strength and temporarily anchored using the reusable mechanical bearing device.

UHPC can then be poured into the block-out while ensuring that it completely fills up the confining device. Once the UHPC hardens and gains a compressive strength of 100 MPa, the strand is released from its temporary anchorage. The UHPC now anchors the strand, and the tail end of the stressing end can then be cut to complete the job. The UHPC surrounding the strand and the confining device encapsulates the anchor without the need for any supplementary encapsulation measures as required in steel mechanical anchors. It is to be noted that this UBA is applicable only to the stressing end of the strand.

Transfer Length Analysis and Design of UBA with Improved Steel Cone

Figures 22A, 22B:
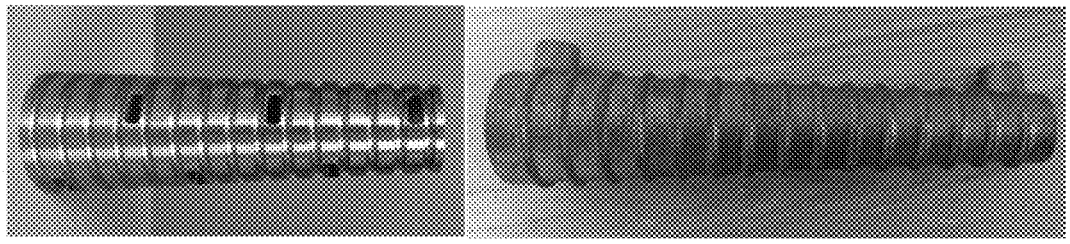
FIGS. 22A-22B shows views of (a) a machined cone and (b) a steel casting cone.
Figure 23:
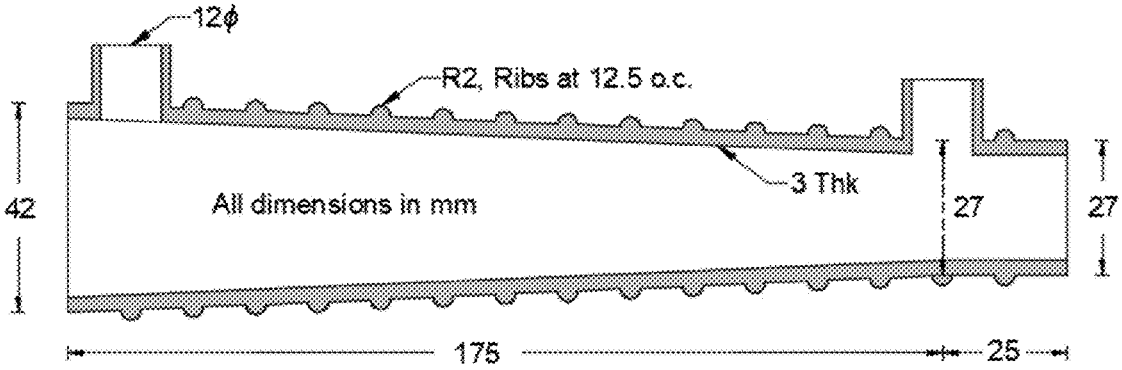
FIG. 23 is a depiction showing dimensions of a steel confining cone device according to aspects of the disclosure.

A preliminary UBA device using a steel cone as disclosed herein could transfer up to approximately 112 kN effective prestressing force from an indented strand in steel confined UHPC to the surrounding concrete within 150 mm. FIG. 22 illustrates the machined cone used in the preliminary tests and the cone used for tests according to the present example. The cost of machining was exorbitant at USD 400 due to the taper on the interior and exterior surface. Although this cone gave the desired performance but was impractical due to the cost. For economy and performance, a new cone was designed that could be cast. The casting is inherently rougher than the machined cone and bonds better with UHPC inside it. The grooves on the machined cone were replaced with ribs in the casting, which are easier to create in the mold for casting. They also perform better than the grooves in bearing against the surrounding concrete. The length of the cone was increased to 200 mm, of which 175 mm was tapered, which was done to ensure full prestress transfer when the effective prestressing force was increased to 134 kN from 112 kN. The uniform thickness of the cone was reduced from 4 mm to 3 mm to match cone weight with steel mechanical bearing anchors. Two 12 mm diameter spouts were also provided to test if UHPC could be pumped into the cone. The resulting cost of the cone casting for a small quantity came to about USD 3 per piece, which is significantly lower than the machined cone. FIG. 23 illustrates the dimensions of the cone casting used in this example.

Figure 24:
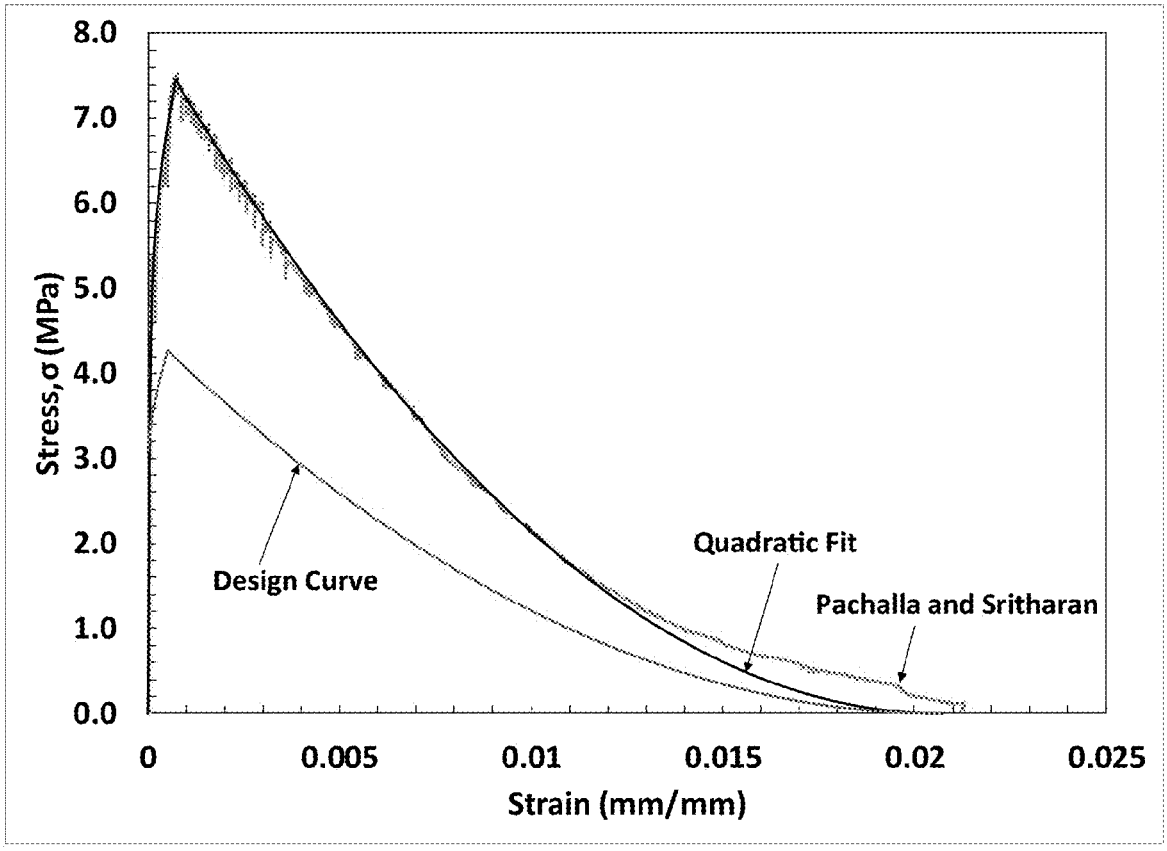
FIG. 24 is a graph showing UHPC tensile stress-strain relationship for 1% fiber content.

The performance of the UBA and the hoop stress variation in the cone along the transfer length was determined analytically. This was done using the thick cylinder theory formulation for steel confined UHPC and the finite element method using Abaqus/CAE® software. The three materials participating in anchoring the prestressing strand into the concrete are the strand itself, the UHPC, and the steel cone. A compressive strength of 100 MPa for UHPC was assumed at the prestress transfer. One of the objectives of the tests was to reduce the steel fiber content. This reduced the tensile capacity of the UHPC and increased the hoop stress in the cone. Hence, a 1% steel fiber content was assumed for analyzing the UBA and the cone stress. A quadratic strain-softening curve was fit to the experimental stress-strain curve (see, e.g., FIG. 24) and then reduced to a design stress-strain relationship for use in the transfer length analysis. The steel fiber orientation in the UHPC confined by the small diameter of the cone can be highly random. The resulting tensile capacity could be much lower than predicted from a direct tension test on a dog-bone specimen. As a conservative approach, the tensile strength ($f_{Utuk}$) is limited to the design tensile strength, $f_{Utud}$, per Eq. (5-1).

$$f_{Utud} = \frac{\eta_t \cdot \eta_{hU} \cdot \eta_k \cdot f_{Utuk}}{\gamma_U} = \frac{(1)(0.8)(1)(7.45)}{1.4} = 4.25MPa \qquad (0\text{-}1)$$

The term $\eta_t$ is the coefficient to account for the loading duration on the resistance of UHPC and is taken as 1.0. The term $\eta_{hU}$ is equal to 1.00 for elements up to 50 mm and 0.8 for elements greater than 100 mm thickness. Interpolate for values in between. It is the coefficient to account for the influence of the thickness of the UHPC layer as well as the fabrication process on the fiber orientation. The term $\eta_k$ is a coefficient related to the fiber orientation in UHPC and is taken as 1.00 for indeterminate elements.

UBA Analysis Using Thick Cylinder Theory

The thick cylinder theory has been successfully applied to determine the transfer length of prestressing strands in precast prestressed concrete. This has been expanded such that the use of the thick cylinder theory can be used to determine transfer lengths of prestressing strands in steel tube confined UHPC at the anchorage zone. The UBA uses a steel cone to confine the UHPC, and so their rationale applies to this paper. Their method is described in brief, followed by the analysis.

Figure 25:
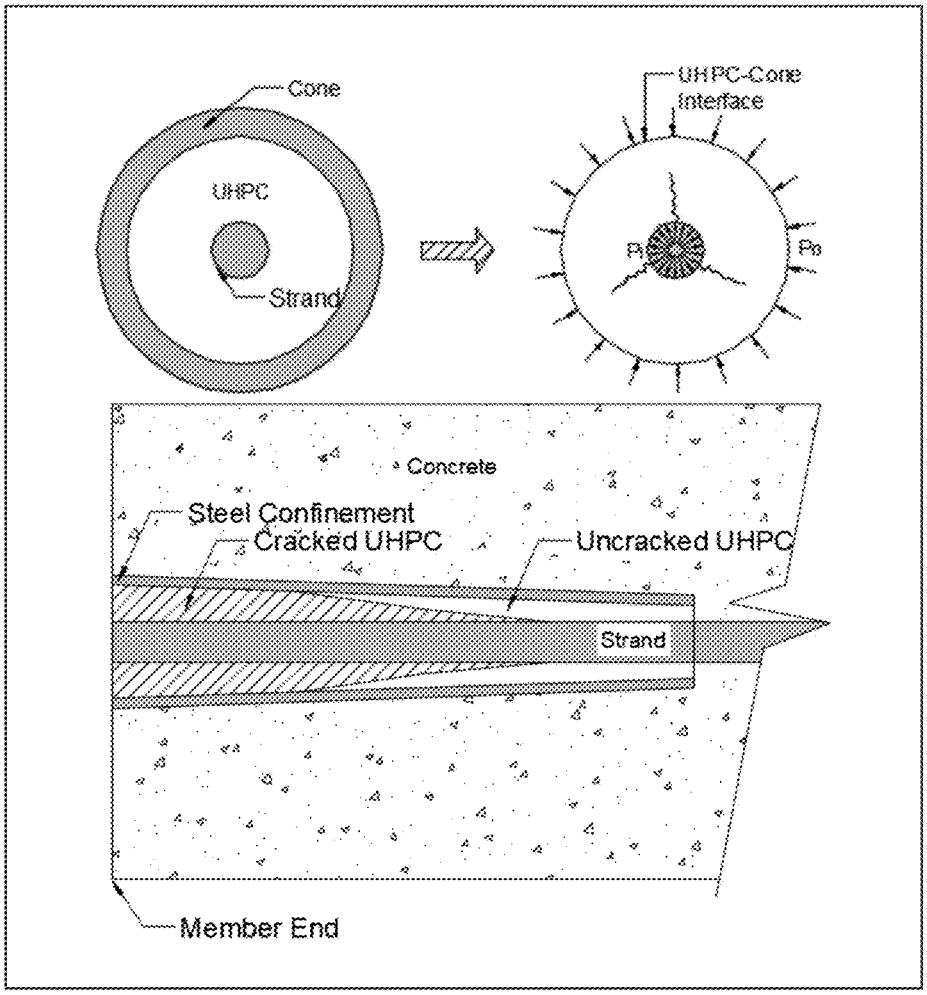
FIG. 25 is a depiction of confined, thick cylinder, interface pressures and cracking in UHPC.

In precast prestressed members, the strand diameter reduces under tension due to Poisson's effect. Upon the strand's release on the hardening of the concrete, the strand tries to regain its original diameter as well as length, which is resisted by the surrounding concrete and the UHPC-concrete bond. This results in the radial expansion of the concrete and the generation of radial compression and hoop tension in the concrete. The concrete reacts with an inwards radial pressure, the magnitude of which depends on the concrete's mechanical properties. For a plane strain analysis, the above resembles the classical thick cylinder subjected to internal pressure, where the concrete acts like the thick cylinder. It is also well known from the theory of elasticity that the application of external pressure on a thick cylinder counters the internal pressure and reduces the radial dilation of the cylinder by confining the cylinder. UHPC has superior mechanical performance compared to conventional concrete. If a portion of the concrete surrounding the strand in the anchorage zone is replaced with UHPC, and if this UHPC is confined with a steel tube or a truncated cone, the performance of the thick cylinder improves significantly. When the UHPC tries to expand radially, the steel cone, being a stiffer material than the UHPC, provides passive resistance or inwardly directs the passive pressure, as shown in FIG. 25. Also, at any cross-section along the transfer length, if the hoop stress in UHPC exceeds its tensile strength, then the UHPC cracks.

Figure 26:
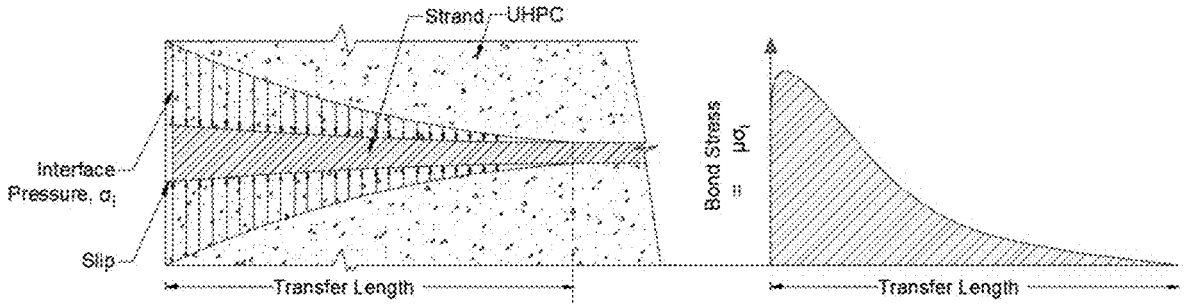
FIG. 26 shows graphs of interface pressure and bond stress at the strand-UHPC interface.

During prestress release, high interface pressure develops between the strand and the UHPC resulting in corresponding high bond stress. The bond stress also depends on the roughness of the strand, which can be represented with a coefficient of friction (μ). As the prestress force transfers into the UHPC along the transfer length, the strand stress increases from zero at the member end to the effective stress at the end of the transfer length. The strand diameter accordingly reduces, and so does the interface pressure and the bond stress, as shown FIG. 26. In this paper, the bond stress at the UHPC-strand is increased using three techniques—creating an indentation on the strand, using UHPC to surround the strand, and confining the UHPC with a steel cone. The increase in bond stress thus helps to reduce the transfer length.

Figure 27A:
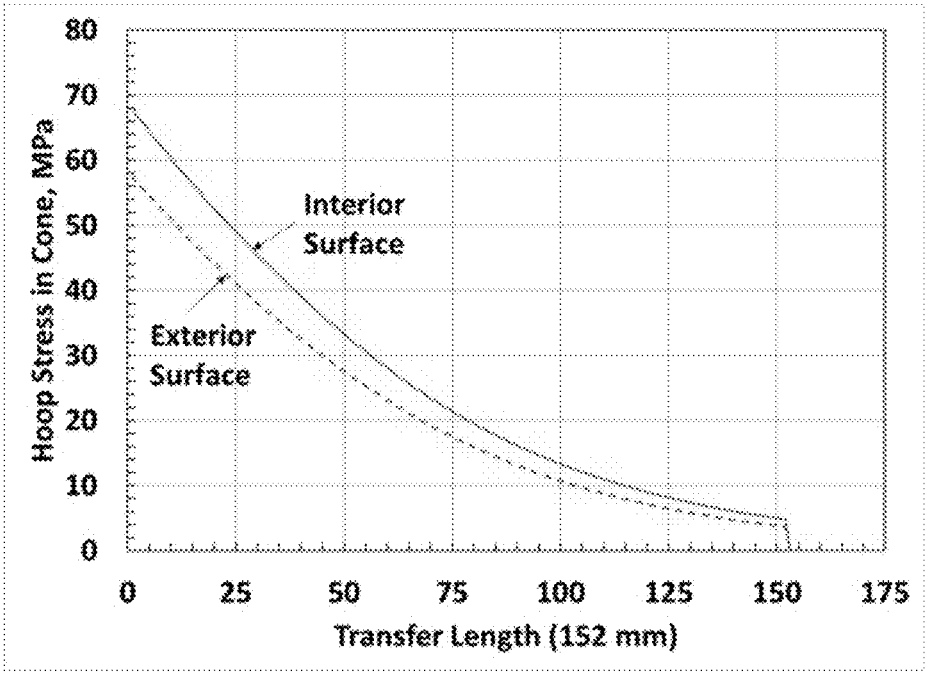
FIGS. 27A-27B show graphs of the hoop stress in the cone, the axial stress in the strand, and the maximum radial stress in the UHPC along the transfer length.
Figure 27B:
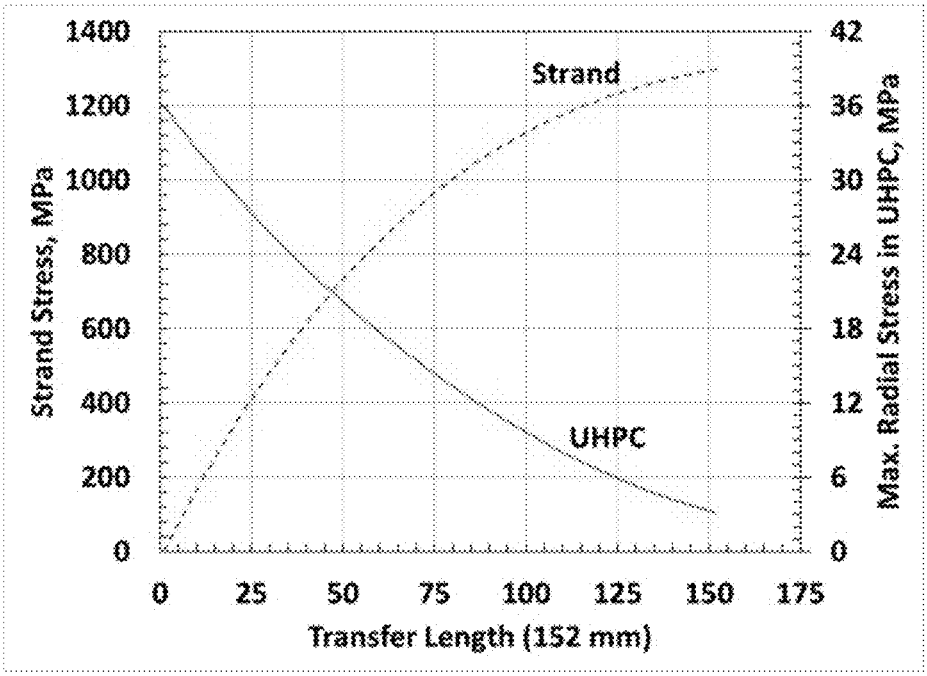

According to some aspects and/or embodiments of the invention, an analytical model assumes a perfect bond at the concrete-cone and the cone-UHPC interface. It also assumes the elastic behavior of the steel confinement tube. The cone used in this example has ribs on its external surface, is rough on the internal surface, and is designed to remain elastic, thus satisfying all assumptions. The model does not accumulate the compression stress in the cone or the UHPC along the transfer length. This assumption is valid due to the assumption of a perfect bond. A high coefficient of friction, μ equal to 1, is used to model the UHPC-strand bond due to the intentional roughening of the strand. The perimeter of the strand is taken as ⅓$^{rd}$ more than as calculated for a circle due to the extra contact area from wire stranding. The maximum crack-width of UHPC is taken as 0.65 mm, consistent with a 1% steel fiber volume content in the UHPC. Prestress transfer is assumed at UHPC compressive strength of 100 MPa, and elastic modulus is calculated. Table 5-1 presents the input data for the analysis. Although the total cone length is 200 mm, the length associated with the tapered portion is 175 mm, which is used for the transfer length analysis. The transfer length comes to 152 mm from the analysis. FIG. 27 illustrates the change in hoop stress in the cone, the radial stress in the UHPC, and the tensile stress in the strand along the transfer length.

TABLE 5-1

Input parameters for transfer length analysis using thick cylinder theory

| | | | | | |
|---|---|---|---|---|---|
| $E_{ps}$ (MPa) | 197,241 | $d_b$ (mm) | 12.7 | $C_{d1}$ (mm) | 42 |
| $E_u$ (MPa) | 38,500 | $A_{ps}$ (mm$^2$) | 98 | $C_{d2}$ (mm) | 27 |
| $E_s$ (MPa) | 200,000 | $f_{se}$ (MPa) | 1339 | $C_{tk}$ (mm) | 3 |
| $v_{ps}$ | 0.3 | $w_o$ (mm) | 0.65 | $C_L$ (mm) | 175 |
| $v_u$ | 0.2 | $f_{Utud}$ (MPa) | 4.26 | μ | 1 |
| $v_s$ | 0.3 | $N_c$ | 1 | | |

The terms $E_{ps}$, $E_u$, and $E_s$ represent the elastic modulus of the prestressing strand, UHPC, and the steel cone, respectively, and the terms $v_{ps}$, $v_u$, and $v_s$ represent the corresponding Poisson's ratio. The terms $d_b$, $A_{ps}$, and $f_{se}$ represent the diameter, area, and the effective stress in the prestressing strand, respectively. The terms $w_o$, $f_{Utud}$, and $N_c$ represent the maximum crack-width, design tensile strength, and the number of radial cracks in the UHPC. The terms $C_{d1}$, $C_{d2}$, $C_{tk}$, and $C_L$ refer to the cone dimensions in relation to FIG. 23. Lastly, μ is the coulomb's friction coefficient at the interface of the strand and the UHPC.

UBA Analysis Using Finite Element Method

Non-Linear finite element analysis was carried out using the Abaqus/CAE software to validate the transfer length and the stress distribution in the steel cone, UHPC, and the strand. The prestressing strand and the steel cone were modeled as an elastic material, and the UHPC material nonlinearity was modeled using the concrete damage plasticity (CDP) model. Table 5-2 lists the CDP parameters used for analysis.

TABLE 5-2

Concrete damage plasticity parameters

| | ψ | ε | $f_{b0}/f_{c0}$ | $K_c$ | μ |
|---|---|---|---|---|---|
| Chen and Graybeal [29] | 15° | 0.1 | 1.16 | 0.6667 | — |
| Stark et al. [26] | 30° | 0.1 | 1.08 | 0.67 | — |
| UBA Transfer Analysis | 30° | 0.1 | 1.08 | 0.6667 | 0.001 |

Mesh sensitivity, convergence, and output energy based parametric studies were performed to establish the CDP parameters for use in this analysis. The dilation angle (ψ) of 30° was used per the mesh sensitivity study. The ratio of the biaxial to uniaxial compressive strength ($f_{b0}/f_{c0}$) is taken as 1.16 for concrete for conventional concrete. You can use a reduced value for $f_{b0}/f_{c0}$ based on tests on fine-grained UHPC. The ratio of the second invariant on the tensile meridian to that on the compressive meridian ($K_c$), and the eccentricity, ε, have been taken. The viscosity parameter, μ, is used to handle the convergence issues associated with the softening portion of the tensile stress-strain.

Figure 28:
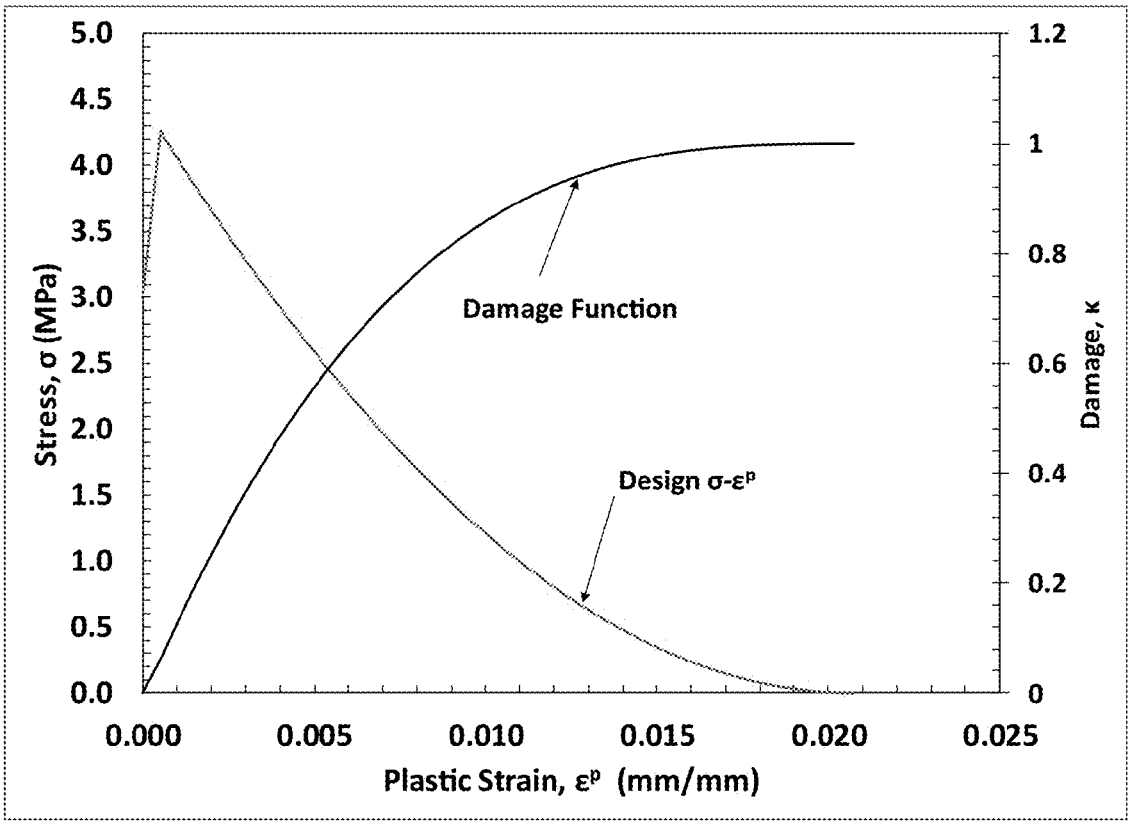
FIG. 28 graph showing UHPC tensile stress vs. plastic strain and tension damage curve.
Figure 29A:
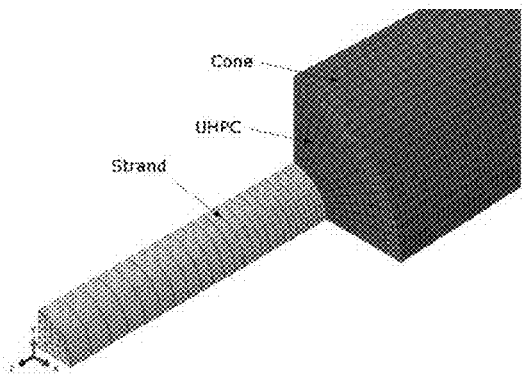
FIGS. 29A-29B show depictions of finite element model of a UBA according to aspects of the disclosure.
Figure 29B:
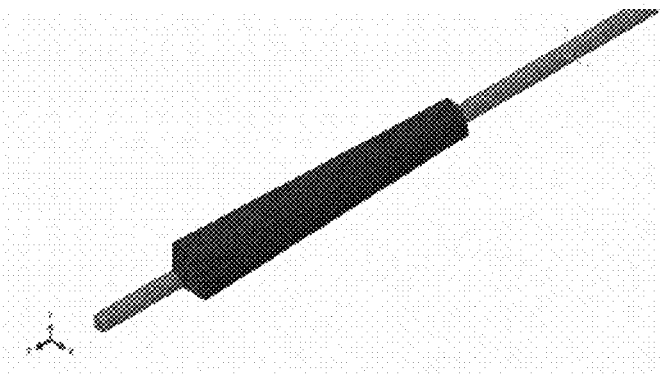
Figure 30A:
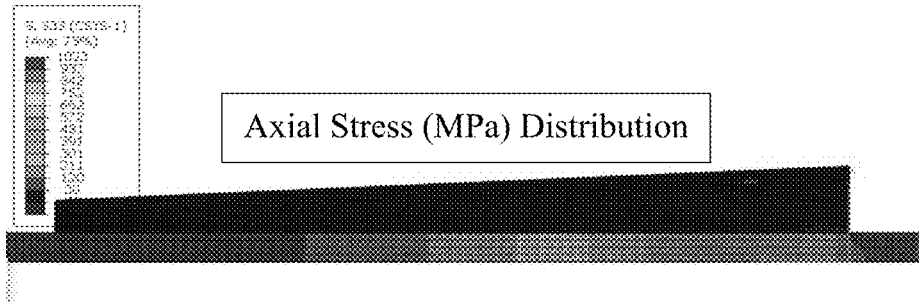
FIGS. 30A-30C show stress distribution in strand and cone from the F.E. model.
Figure 30B:
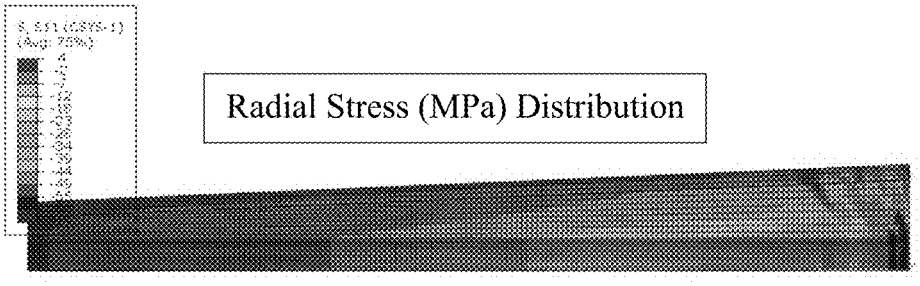
Figure 30C:
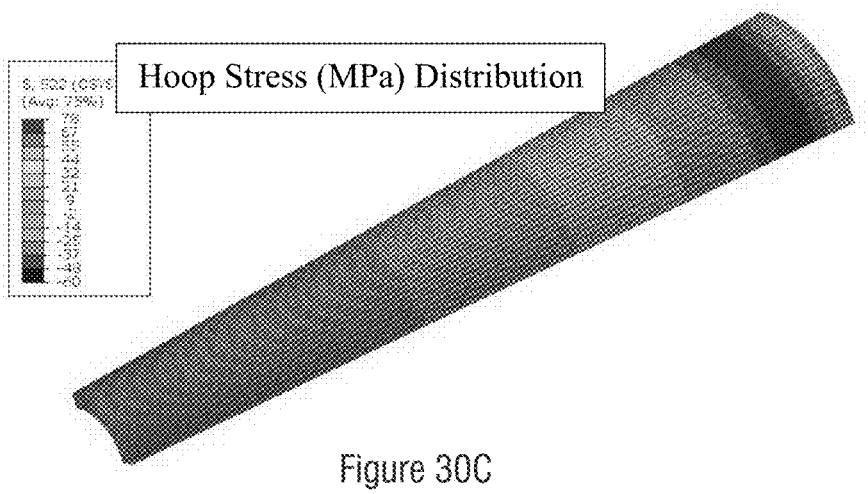
Figure 31A:
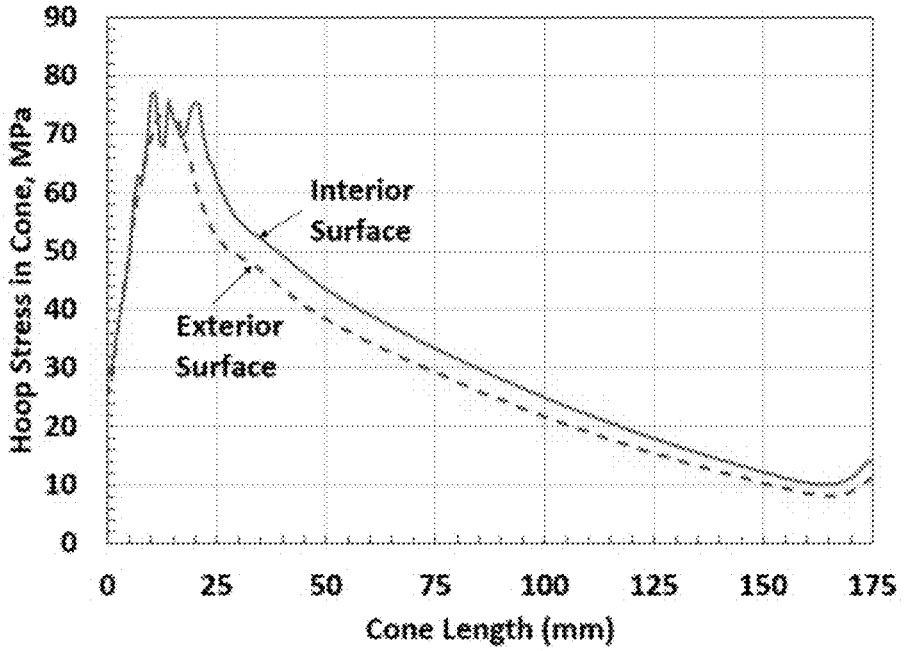
FIGS. 31A-31B show graphs of stress distribution in UHPC from F.E. Model.
Figure 31B:
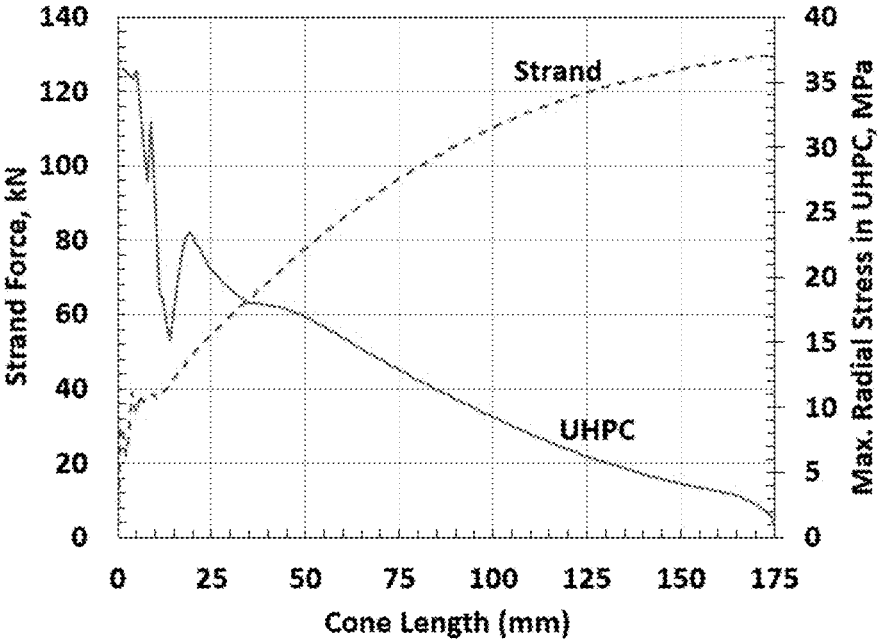

The experimental tests on the UHPC bond anchors have not shown any sign of UHPC crushing due to prestress release; therefore, non-linear behavior in compression is not expected. Axial compressive stresses in the UHPC do not add up along the transfer length as they are continually transferred to the surrounding concrete through the ribs in the steel cone. A bilinear elasto-plastic stress-strain curve is used to model compressive behavior. The tensile behavior in UHPC is modeled using the design stress-strain curve shown in FIG. 24. Equation (5-2) is used to calculate the tension damage (κ) for a uniaxial tensile stress state, where, $g_f$, the fracture energy, is the total area under the stress-plastic strain curve. FIG. 28 illustrates the stress vs. plastic strain and the tension damage vs. plastic for UHPC with 1% steel fiber volume, and Table 5-3 lists the input parameters used for modeling. The cone dimensions and the material properties were taken from Table 5-1. The strand-UHPC and the UHPC-cone bond is modeled using coulomb's friction. The strand is modeled as a circle using the nominal diameter; hence, the initial stress applied to the strand was adjusted to match the actual effective prestressing force of 134 kN. The initial prestress was applied using the predefined stress module. A 3-dimensional doubly-symmetric quarter model was developed. The eight-noded C3D8R brick element with reduced integration from the Abaqus® library was used to mesh the model per FIG. 29. The general-contact interaction was used to model the surface to surface contact between the materials. The external surface of the cone was restrained against displacement in the longitudinal direction to imitate the bearing of the cone against the concrete and the restriction of the cone against slipping provided by the ribs on the cone. FIG. 30 and FIG. 31 illustrates the stress distribution in the strand, UHPC, the cone after the prestress release.

$$\kappa = \frac{1}{g_t}\int_0^{\varepsilon^p} \sigma . d\varepsilon^p \tag{0-2}$$

TABLE 5-3

Input parameters for Transfer Length Analysis using FEM

| $d_b$ (mm) | $f_{se}$ (MPa) | μ (Strand-UHPC) | μ (UHPC-Cone) |
|---|---|---|---|
| 12.7 | 1058 | 1.2 | 1.2 |

Both the thick cylinder theory and finite element method show that the transfer length of roughened strands in confuted UHPC can be restricted to within 175 mm. They also confirm that the steel cone remains elastic prestress transfer.

Design for Bearing

Figure 32A:
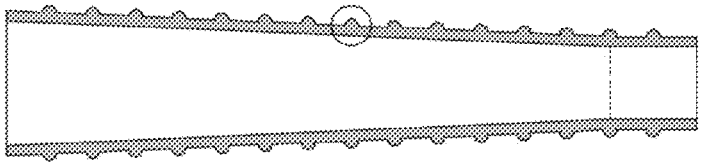
FIGS. 32A-32B are schematics showing bearing of cone ribs on concrete.
Figure 32B:
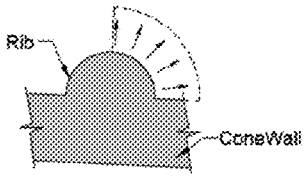

As illustrated in FIG. 32, the cone is designed such that the ribs on its external surface provide sufficient bearing against UHPC to transfer the entire prestressing force along its length. The cross-section area of the cone at its narrow end is sufficiently small, and any contribution from it towards end bearing on UHPC can be ignored. ACI 423-7 provides acceptability criteria for anchorage bearing in unbonded single-strand anchors. The net bearing area, $A_b$, is the summation of one-half of the rib surface areas. The actual bearing stress on concrete at transfer, 35.9 MPa, is given by Eq. (5-3). The allowable average bearing capacity of UHPC at transfer and during service is given by Eqs. (5-4) and (5-5), $$f_b = \frac{P}{A_b} = \frac{134000N\sqrt{2}}{5277\ \text{mm}^2} = 35.9MPa \tag{0-3}$$

-continued $$f_{cp} = 0.75f'_{ci}\sqrt{\frac{A'_b}{A_b}} \not> 1.2f'_{ci} \text{ at Transfer} \tag{0-4}$$

$$f_{cp} = 0.6f'_c\sqrt{\frac{A'_b}{A_b}} \not> f'_c \text{ during Service} \tag{0-5}$$

Although the distance from any rib to the nearest UBA edge is several times that of the rib size but for the purpose of calculating the projected area, $A'_b$, the ratio $$\frac{A'_b}{A_b}$$

is limited to 2 in this example. For a given UHPC compressive strength at transfer ($f'_{ci}$) of 100 MPa, and at service ($f'_c$) of 150 MPa, the corresponding bearing strength comes to 106 MPa and 127 MPa, respectively. These values are much higher than the bearing stress of 35.9 MPa, and hence the ribs are expected to perform satisfactorily in bearing.

Experimental Testing

Figure 33:
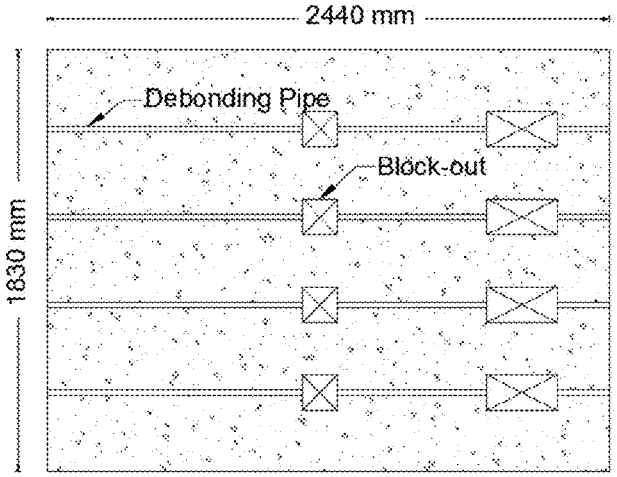
FIG. 33 is a schematic of a concrete slab layout for testing.
Figure 34A:
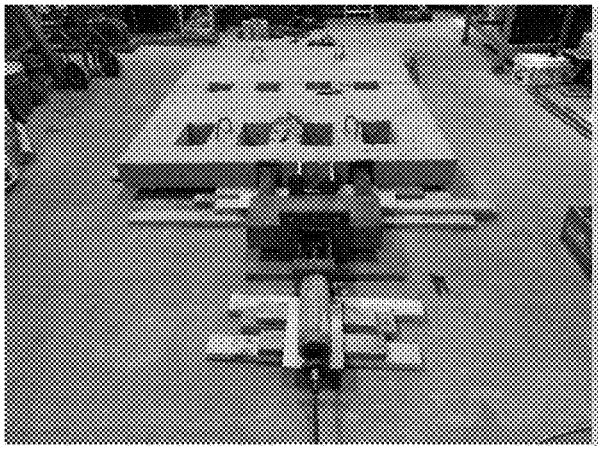
FIGS. 34A-34B show photographs of a test set of the UBA according to Tests 1-4 of Example 2 of the present disclosure.
Figure 34B:
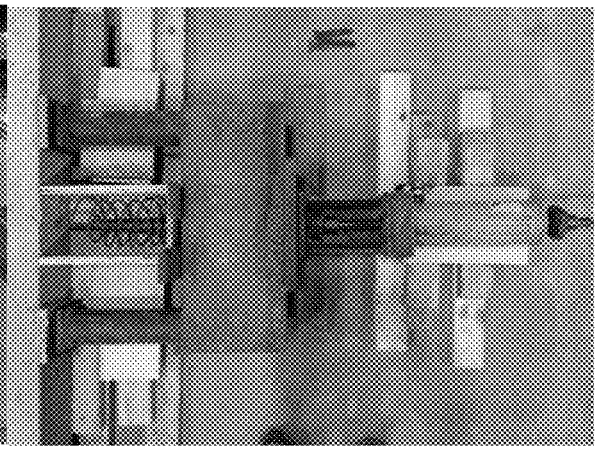
Figure 35A:
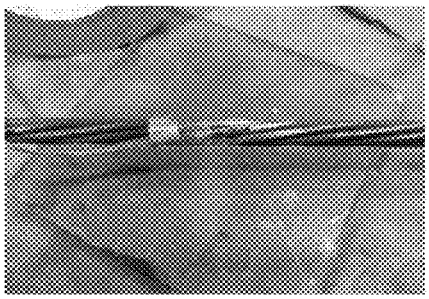
FIGS. 35A-35C show photographs of tension tests on roughened strands.
Figure 35B:
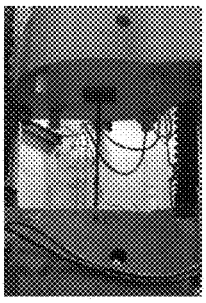
Figure 35C:
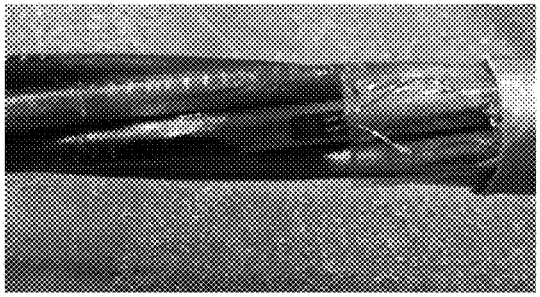
Figure 36A:
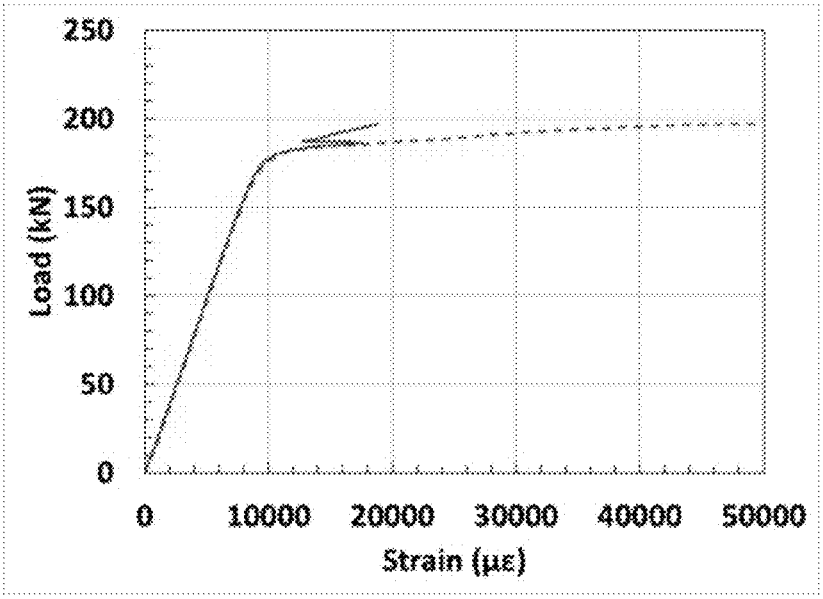
FIGS. 36A-36B show graphs including a stress-strain graph for (a) specimen #2 and (b) #3 for tension test according to Example 2 disclosed herein.
Figure 36B:
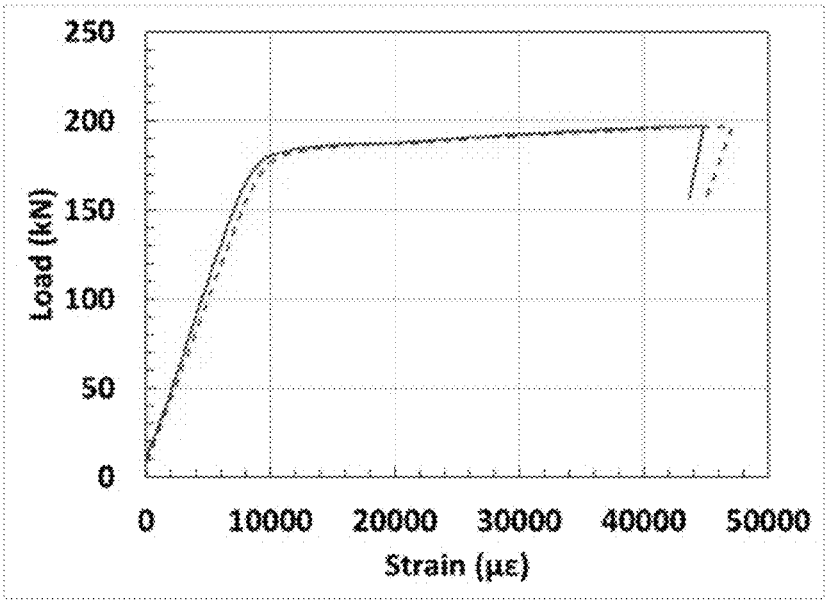
Figure 37A:
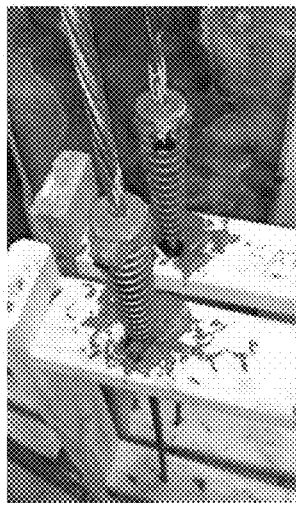
FIGS. 37A-37D shows photographs including (a) Bond Test Set-up; (b, Far Right) Strand Slip after Test.
Figure 37B:
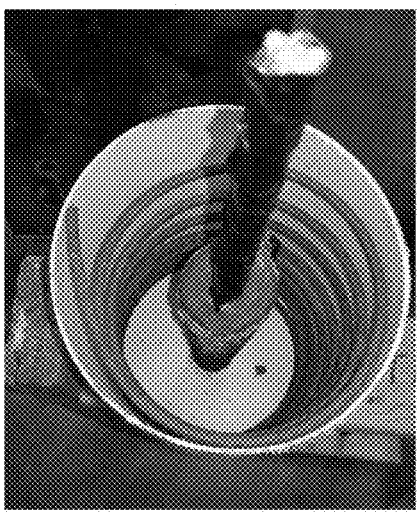
Figure 37C:
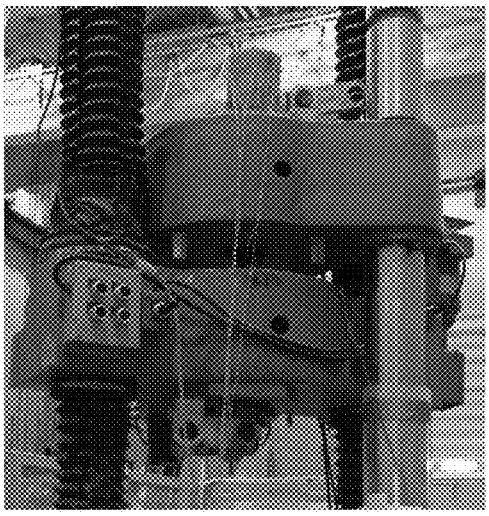
Figure 37D:
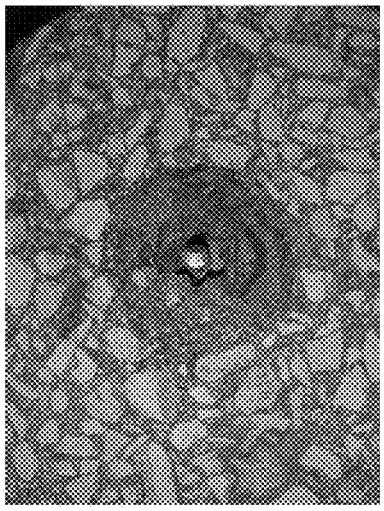

Three different sets of experiments were conducted as part of this Example. In the first set of experiments, tension tests were carried on prestressing strand samples with strand roughening to assess their strain-strain characteristics. In the second set of experiments, pull-out tests were carried out on untensioned roughened strands surrounded by UHPC that was confined within the new cone casting. The casting was surrounded by NC. The third set of experiments was to test and optimize the UBA with the new cone casting. This set included a total of seven tests, as listed in Table 5-4. As illustrated in FIG. 33, a 150 mm thick slab having slots for four tests was cast with concrete having a cylinder compressive strength of 34.5 MPa. Debonding pipes were run through mid-depth of the slab to allow the prestressing strand to be threaded through the slab. Two block-outs were provided along each debonding pipe. The smaller block-out of size 150 mm×150 mm was used solely for attaching strain gauges to the strands. The larger block-out of size 190 mm×340 mm served two purposes. In Tests 1 to 4 and 7, per FIG. 34, the UBA was cast outside the slab so that the concrete slab could be reused. The larger block-outs, in this case, was used to attach strain gauges on the unbonded strand. In Tests 5 and 6, the larger block-out was used to assemble the UBA inside it.

TABLE 0-11

UBA Test Matrix

| Test # | UBA Block Size (mm) | Concrete (M34.5) (mm) | Bond Length (mm) | Spiral in Concrete | Fiber % | Sudden Release Method | $f'_{ci}$ at Release (MPa) | $f'_c$ at Pullout (MPa) |
|---|---|---|---|---|---|---|---|---|
| 1 | 150 × 150 × 305 | — | 305 | Yes | 2.00 | Torching | 146 | 150 |
| 2 | 150 × 150 × 305 | — | 305 | Yes | 1.00 | Torching | 116 | 118 |
| 3 | 150 × 150 × 305 | — | 200 | Yes | 1.00 | Actuator | 126 | 139 |
| 4 | 75 × 75 × 286 | 150 × 150 × 286 around UHPC | 286 | No | 0.75 | Actuator | 144 | 136 |
| 5 | 75 × 75 × 305 | 150 × 150 × 305 around UHPC | 305 | No | 0.75 | Actuator | 100 | 88 |
| 6 | 75 × 75 × 305 | — | 305 | — | 0.75 | Actuator | 100 | 88 |
| 7 | 75 × 75 × 305 | — | 305 | — | 0.50 | Actuator | 88 | 88 |

Materials Used in Testing

A total of five materials were used during the tests. They are NC, reinforcement steel, UHPC, steel cone, and prestressing strand. The NC with a cylinder compressive strength of 34.5 MPa and reinforcing steel having a minimum yield strength of 420 MPa were used to build the slab. The steel cone used was cast with EN-8 material conforming to British standard BS970, equivalent to AISI 1045 and ASTM A536. The tensile stress in the steel cone is expected to remain elastic and much below its yield strength of 400 MPa. The UHPC used through the experimental phase was limited to. Lafarge Ductal® proprietary grey and light grey premix. Dramix® steel fibers from Bekaert® were used for the experimental work and were supplied by Lafarge. The steel fibers have a diameter of 0.175 mm, a length of 13 mm, and tensile strength of about 3000 MPa. The UHPC mix-design used for the tests is shown in Table 5-5. Prestressing strand conforming to ASTM A416 specifications with minimum ultimate tensile strength, $f_{pu}$, of 1860 MPa. 12.7 mm diameter seven-wire prestressing strands are used throughout the testing phase. Material from the same coil was used throughout the experimentation. Table 5-6 lists the mechanical properties of the strand.

TABLE 5-5

UHPC Mix Design

| Specimens | UHPC | Premix (Kgs/Cu.m) | Water (Kgs/Cu.m) | Admixtures (Kgs/Cu.m) |
|---|---|---|---|---|
| 1 | Grey | 2195 | 117 | 30 |
| 2-7 | Light Grey | 2195 | 125 | 53 |

TABLE 0-13

Mechanical Properties of the Prestressing Strand

| Tensile Strength (kN) | Yield Strength (kN) | Elongation (%) | Area ($mm^2$) | Elastic Modulus (MPa) |
|---|---|---|---|---|
| 198.6 | 181.5 | 5.1 | 98.0 | 197241 |

Tension Tests on Roughened Strands

Tension tests were performed on three 940 mm long strand samples. The center 305 mm length of the strand was roughened per specifications as disclosed herein. The purpose of the tests was to check if the strand roughening was substantially reducing the strand strain at fracture. A Satec universal testing machine (UTM) was used for the tests. Two strain gauges were provided at the center of each specimen on two different wires of the strand. The clear gauge length between the grips was 534 mm. The strand was pulled at the rate of 19 mm/sec. Two of the three samples fractured at the mid-height of the strand, while once fractured inside the grips of the (UTM). The strands were able to achieve around 4% strain in all the tests, as listed in Table 5-7. This implies that there should be no reason for premature strand fracture inside the UBA. The UHPC fits itself into the rough indentations and does not bite into the strand. In addition, as the UHPC completely surrounds the strand inside the confining cone, there is no reason for any imperfect wedge fit. Thus, the prescribed mechanical roughening process can be deemed to work well with prestressing strands without having any meaningful effect on its strain capacity.

TABLE 5-7

Strains from tension tests on roughened strands

| Specimen # | SG#1 (με) | SG#2 (με) | Fracture Load (kN) |
|---|---|---|---|
| 1 | 34000 | 46812 | 195.4 |
| 2 | 18840* | 49596 | 196.9 |
| 3 | 44765 | 47122 | 196.9 |

*Lost strain gauge just after yielding of the strand

Bond Tests on Untensioned Roughened Strands

Pull-tests were performed on roughened untensioned strands surrounded by UHPC confined in the conical steel casting. The purpose of the tests was to get the average bond stress and compare it with the average bond stress between pretensioned strands and UHPC confined with the steel cone. Two short-length strands were roughened as disclosed herein. They were placed in a jig with the conical steel castings, as illustrated in FIG. 37 and filled with UHPC. One specimen has no steel fibers in the UHPC, whereas the other has a 1% fiber content by volume. Once the UHPC was set, the strand with the cone was put inside a 150 mm diameter× 200 mm high plastic mold. A spiral made of 40 mm steel wire having a pitch of 38 mm was placed in the mold, and NC poured into it.

Figure 38A:
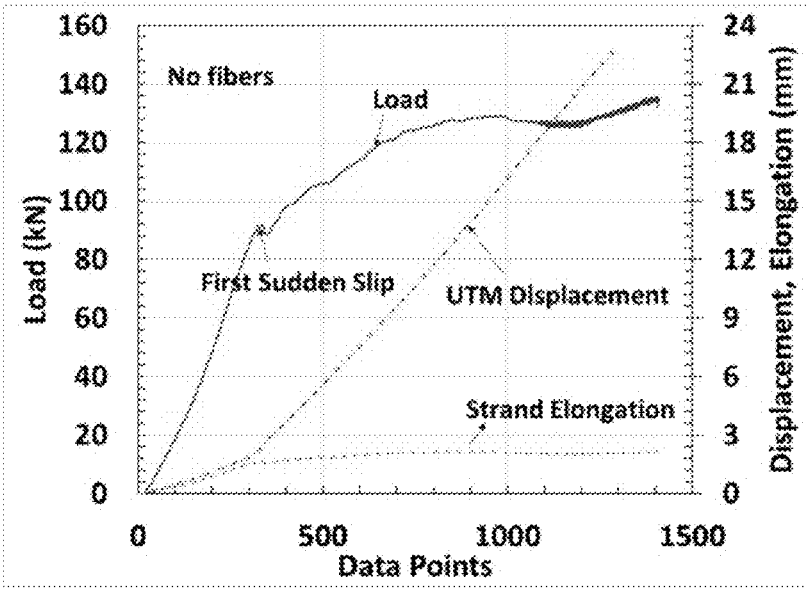
FIGS. 38A-38B show Pull-out load test graphs on untensioned strands.
Figure 38B:
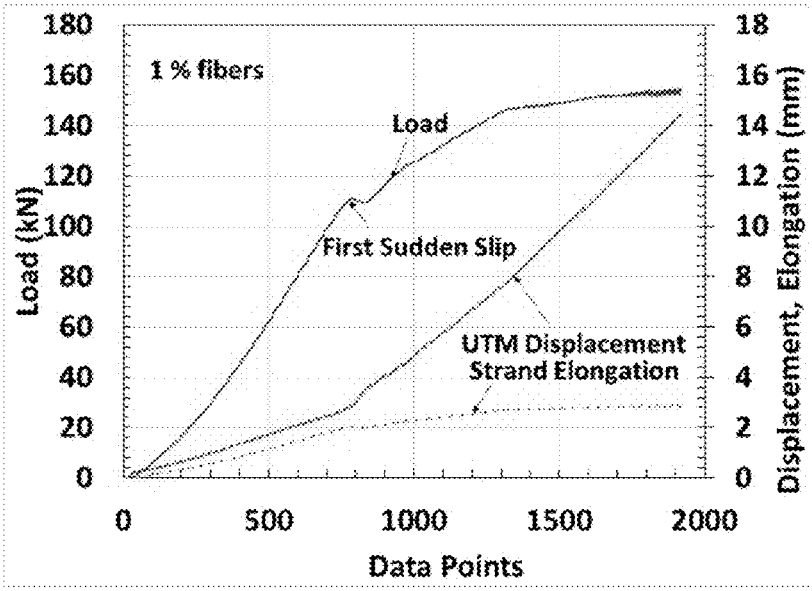

The pull-test was done on a Satec UTM once the UHPC had gained 145 MPa compressive strength. The compressive strength of NC at this time was 40 MPa. The free length of the strand between the NC block and the grips of the UTM was 356 mm. The graphs in FIG. 38 illustrate the pull-outs loads and the associated strand slip, which can be calculated as the difference between the UTM displacement and the strand elongation.

It can be seen from the graphs that the strand slip is negligible until the first load drop. This load drop was associated with a sudden slip of the strand. Beyond this point, the graphs show a divergence between the UTM displacement and the strand elongation, signifying a continually increasing slip. The load gain also becomes non-linear beyond the point of first sudden slip. This point can be called the point of pull-out failure. For the specimen with no fibers and 1% fibers in the UHPC, the corresponding pull-out load is 91 kN and 110 kN, respectively. The corresponding bond stress for 0% and 1% fiber content is 0.46 kN/mm and 0.55 kN/mm. In comparison, it had been found that the bond stress of smooth strand in 300 mm long UHPC samples to be 6.21 MPa, which equates to 0.33 kN/mm. The perimeter of a 12.7 mm prestressing strand is taken as 4/3rd of the actual perimeter.

UBA Testing

Testing Procedure

All tests followed similar testing protocols as detailed herein. The strand was first roughened for a short length and threaded such that the roughened length falls into the UBA region. The cone was then positioned into the UBA block while threading the strand through the debonding pipe, and then symmetrically centered on the strand. Further, the strain gauges were placed on the strands in the slab block-outs. In Tests 4 to 7, strain gauges were also placed on the cone. The strand was then tensioned to 134 kN. In Tests 1 and 2, the actuator was released post stressing, and the strand was temporarily anchored using a steel barrel anchor and wedges. The short length of the strand led to high seating losses. Test 3 onwards, the actuator was locked and held in place after reaching the peak stressing force to avoid seating loss. After a day, UHPC was poured into the UBA block, and it was ensured that the UHPC flowed through the cone and filled it. The UHPC was wet cured, and once it gained a minimum compressive strength of 100 MPa, the strand was released by a sudden release procedure. In Tests 1 and 2, the strand was released suddenly by torching it through the barrel anchor with an oxy-acetylene torch. Test 3 onwards, the strand was suddenly released by quickly releasing the hydraulic pressure in the actuator holding it. The readings on the strain gauges and the loadcell were noted prior to and after strand release. It was possible to visually check the UBA all around in Tests 1 to 4, 6, and 7 for cracks related to prestress release. The anchor was also tested for performance in strand pull-out. After the UHPC had gained further strength in compression, the strand was pulled-out from the fixed-end using an actuator. A DCDT was placed at the far end of the UBA to get slip data of the strand. Strains were also measured during the pull-out test until failure by slip or by fracture.

Test Set-Up

Figure 39A:
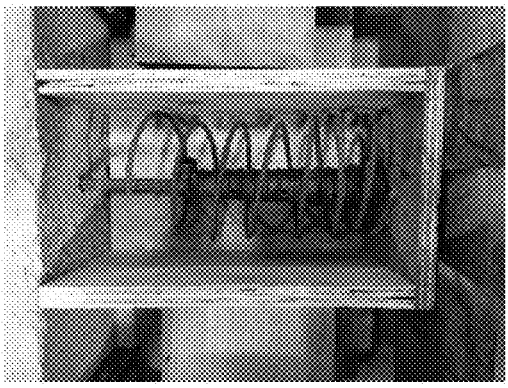
FIGS. 39A-39B show photographs of UBA Layout before UHPC Pour and after Strand Release.
Figure 39B:
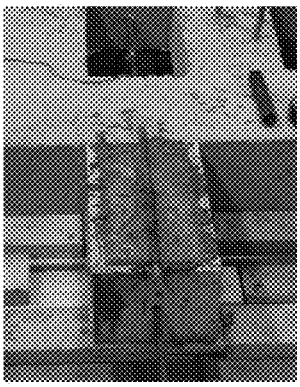
Figure 40A:
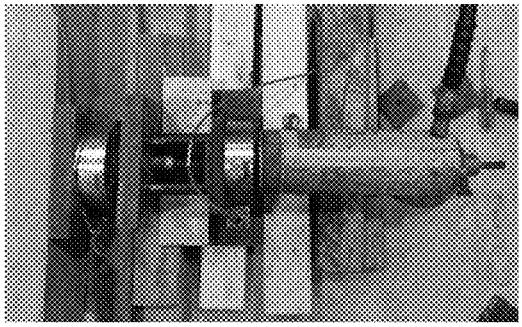
FIGS. 40A-40C show photographs of a Pull-out Test Set-up. (a) Actuator at Fixed End. (b) UBA with DCDT.
Figure 40B:
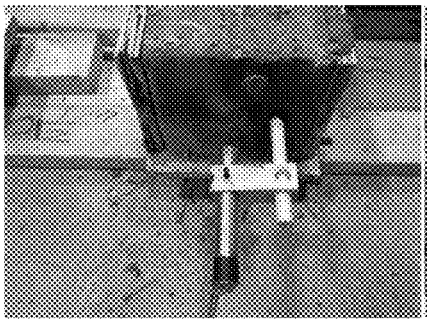
Figure 40C:
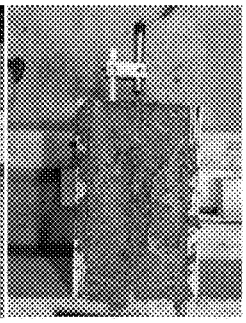

Tests 1 and 2 were similar in all aspects except that in Test 2, the UHPC was changed from Grey to Light Grey version of Ductal®, and the steel fiber content was reduced from 2% to 1%. As illustrated in FIG. 39, the UBA set-up was outside the slab. In addition to the cone, a 100 mm spiral having a pitch of 38 mm and made with a 40 mm steel wire was also provided. This was done to contain or eliminate cracks that have been reported in other UBA. FIG. 40 illustrates the set-up of the actuator at the fixed end and the DCDT at the UBA for the pull-out test.

Figure 41A:
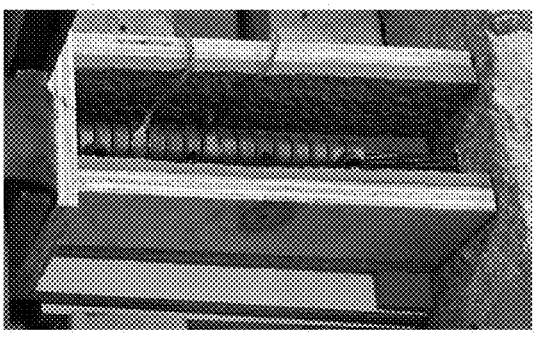
FIGS. 41A-41C show photographs of (a) Test 4 formwork set-up for UHPC core; (b and c) After release.
Figure 41B:
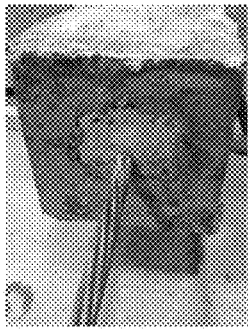
Figure 41C:
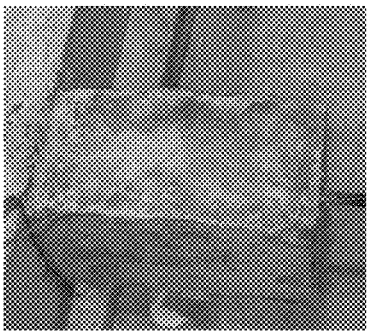

Test 3 set-up was similar to Test 2, except that the strand in the UBA beyond the cone was also debonded, limiting the bonded length to 200 mm within the cone. This was done to test if 200 mm bond length was enough to anchor the strand both during strand release and at pull-out. Although analysis showed that 200 mm was sufficient for effective prestress force transfer, Tests 1 and 2 could not confirm that due to the full-length bond inside the UBA. Strain gauges were not provided on the strand inside the UBA due to its high roughness. Also, adding a strain gauge inside the UBA would have resulted in the loss of at least 25 mm bond length. For Test 4, several changes were made in the set-up. The fiber content was reduced to 0.75%, the spiral was eliminated, and the UBA cross-section of 150 mm×150 mm was a combination of a 75 mm×75 mm UHPC core with a wrapping of NC. As illustrated in FIG. 41, the UHPC core was first poured in a formwork lined with form-liners to create a rough finish on the UHPC. After the UHPC had hardened, the formwork was removed, and concrete poured around the core in an expanded formwork. The concrete wrap was unreinforced and without steel fibers. Strain gauges were also provided on the steel cone.

In Tests 5 and 6, the UBA was prepared in the larger block-out of the concrete slab. The UBA in Tests 5 and 6 were stressed and released together. Test 5 was a repeat of Test 4, whereas the UBA in Test 6 had the same UHPC core as Test 4 but without any concrete wrap. FIG. 41 shows the UBA arrangement inside the slab block-out for Tests 5 and 6. Test 7 was a repeat of Test 6 with two changes. The UBA was provided outside the slab, and the steel fiber content in the UHPC was reduced to 0.50%

Figure 42A:
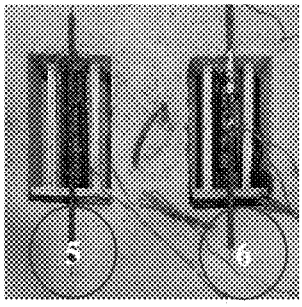
FIGS. 42A-42C shows photographs of tests 5 and 6 set-ups before and after UHPC pour and after the concrete wrap.
Figure 42B:
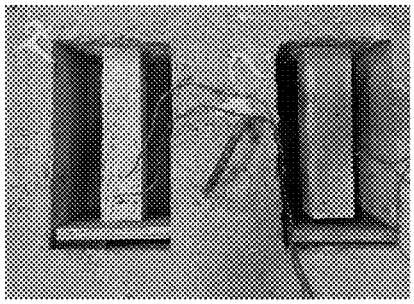
Figure 42C:
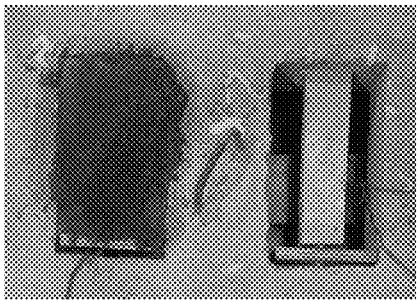
Figure 43A:
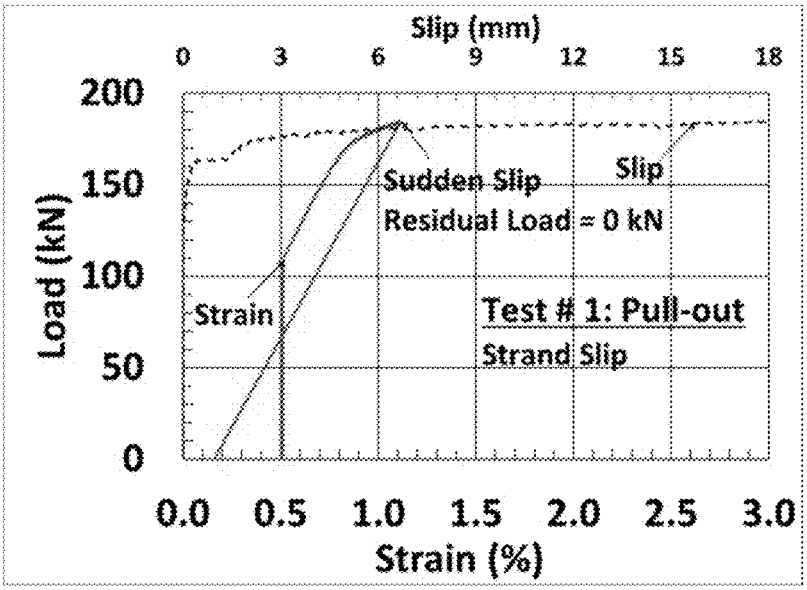
FIGS. 43A-43D show graphs of Load vs. Strain and Slip Data for Pull-out Tests 1 to 4.
Figure 43B:
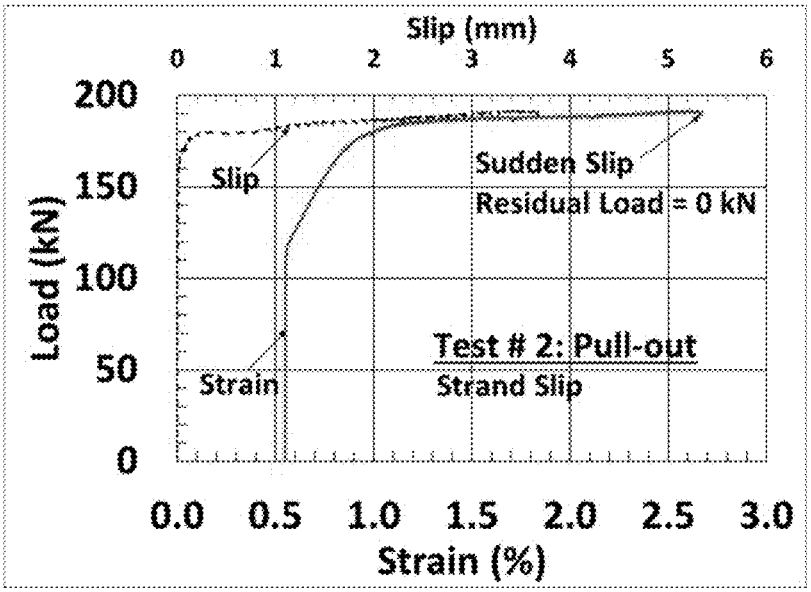
Figure 43C:
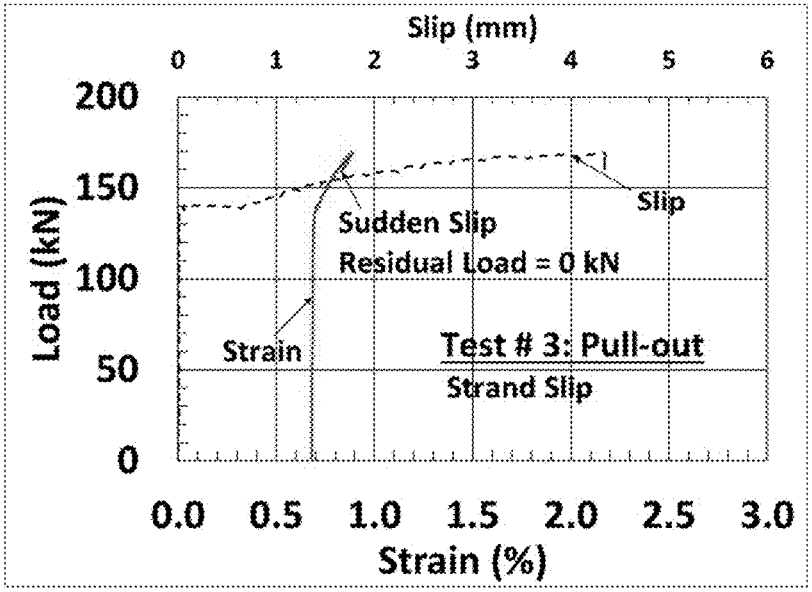
Figure 43D:
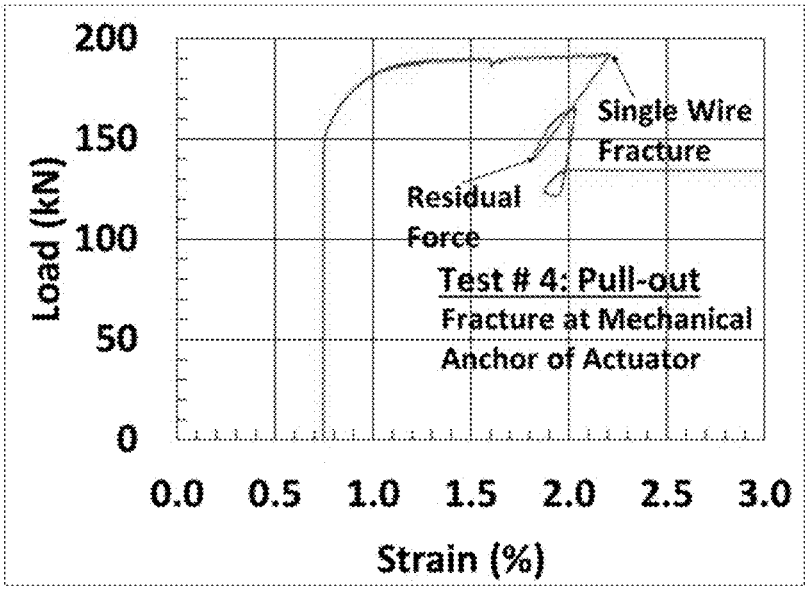
Figure 44A:
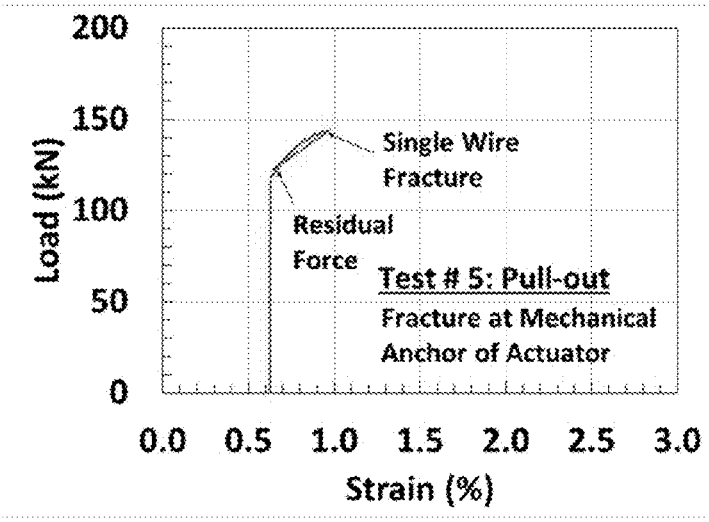
FIGS. 44A-44C show graphs of Load vs. Strain and Slip Data for Pull-out Tests 5 to 7.
Figure 44B:
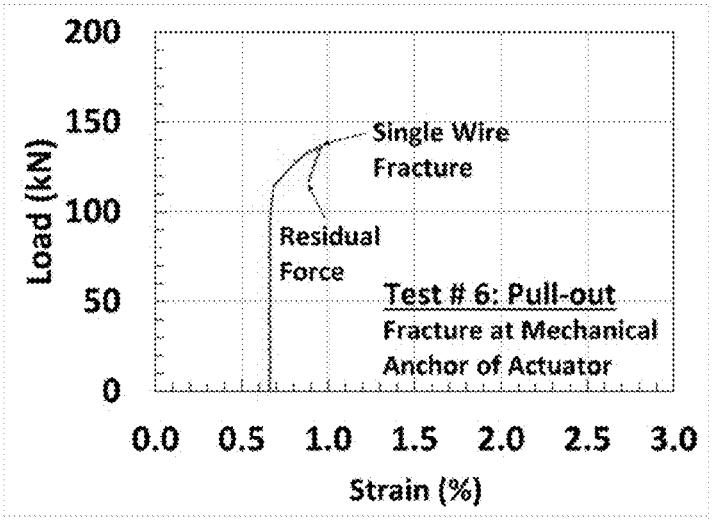
Figure 44C:
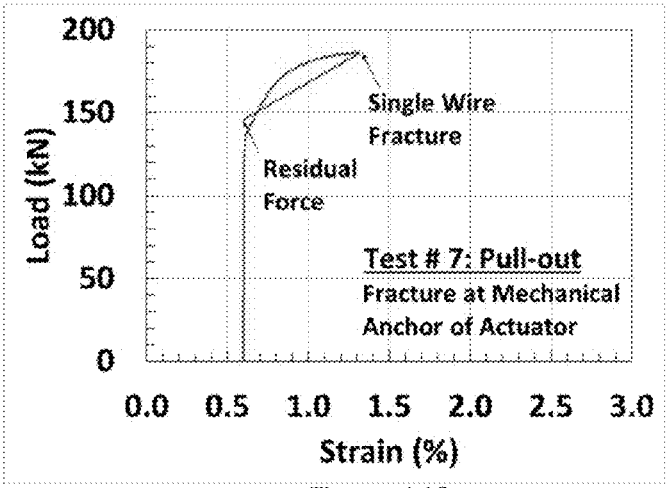

Table 5-8 provides a summary of the forces and strains in the strand obtained at all test stages of the seven tests. FIG. 42 and FIG. 43 illustrate the stress-strain and slip graphs from the pull-out tests. It can be seen that in all tests, the UBA was able to successfully anchor strand during prestress release and transfer the full effective prestressing force in the strand. The steel fiber content in the UHPC was varied from 2% to 0.5%, while the effective prestressing force at strand release was increased from 107 kN to a maximum of 137 kN. It can be inferred that the low fiber content does not any effect on the bond properties between the strand and the UHPC. No cracking was visible in the UBA during any phase of the testing.

During the pull-out in Test 1, the initiation of the slip was recorded at a load of 121 kN, followed by a load plateau at 163 kN. This was followed by a load gain up to 184.7 kN, at which point a sudden slip led to a full loss of load in the strand. A maximum strain of 1.1% was recorded at peak strand load. Similarly, in Test 2, initiation of the slip was recorded at a strand load of 169 kN, followed by a load plateau at 178 kN and a peak load of 191.7 kN when sudden slip occurred at a strain of 2.67%. Two reasons can be attributed to the slip failure in Test 1 and Test 2. The first is the sudden release of the strand by torching, which leads to damage of the strand-UHPC bond. Preliminary tests have suggested that loss of individual wire in the strand during the torching process could be detrimental to the strand-UHPC bond. The difference in peak strain can be attributed to the level of bond damage, which can highly vary depending on whether a single wire or multiple wires get cut at a time during the torching procedure. Secondly, the lower effective stress leads to a low Hoyer effect resulting in low average bond stress. Both issues could be tackled by keeping the stressing actuator in place and under pressure until strand release. Hence, further testing was carried out with the actuator in place.

Test 3 used a curtailed bond length of 200 mm inside the UBA. The full transfer of effective prestressing force proves that the transfer length in the UBA is less than 200 mm. During pull-out, strand slip initiated at a load of 138 kN, followed by a load plateau at 140 kN and a peak load of 169.4 kN at 0.89%. It can be inferred that a length of 200 mm is not sufficient for development. Due to the quick release of the actuator pressure, bond damage can be ruled out. The slip can be attributed to the insufficient bond length. The average bond stress can be calculated as 140 kN/200 mm equal to 0.7 kN/mm. In Test 4, the UBA did not fail in pull-out. Instead, the strand fractured inside the mechanical anchor used at the actuator for pulling the strand out. The DCDT measured a maximum slip of 0.11 mm at the peak load of 192.2 kN and a corresponding strain of 2.2%. This test also proved that a smaller cross-section size of the UBA is adequate. The concrete wrap around the UBA did not indicate any signs of cracking, although it did not contain any reinforcement or steel fibers.

Tests 5 and 6 appear to have used improper strands that could have been used in previous tests. During the stressing phase, there were unusually high relaxation losses, and additional pressure had to be applied to bring to the load back to the desired values. Although the transfer of prestressing was successful, during the pull-out tests, the strands in both tests fractured prematurely at low loads and strains inside the mechanical anchor used with the actuator. Again, the UBA did not fail, and there was no strand-slip until fracture of the strands. Test 7 was a repeat of Test 6 with 0.5% steel fibers in the UHPC. In this test as well, the UBA performed satisfactorily. The strand developed a force of 186 kN at a corresponding strain of 1.3% but again fractured inside the mechanical anchor at the actuator. There was no slip in the strand until its fracture. It can be inferred that the UBA is performing better than the conventional steel mechanical bearing anchor.

Table 5-9 lists the maximum hoop strains recorded on the external surface of the cone. The maximum recorded stress of 58 MPa from Test 4 confirms that the steel cones will remain elastic under ultimate loads. The hoop stress of 50.4 MPa also compares well with analysis results in FIG. 27 and FIG. 30. It can be inferred from the tests that the cone does not dilate sufficiently to crack the UHPC outside. Additionally, the development length of the strand is not more than twice the transfer length.

TABLE 0-15

UBA Test 1 to 7 results - force and strain in prestressing strand

| | Test 1 | | Test 2 | | Test 3 | | Test 4 | |
|---|---|---|---|---|---|---|---|---|
| Test Stage | Force kN | μStrain mm/mm | Force kN | μStrain mm/mm | Force kN | μStrain mm/mm | Force kN | μStrain mm/mm |
| Before Seating | 134.3 | 6899 | 135.3 | 6860 | 138.0 | 7068 | 138.5 | 7750 |
| After Seating | 107.2 | 5379 | 115.6 | 5553 | 138.0 | 7068 | 138.5 | 7750 |
| Before Release | 104.6 | 5249 | 115.4 | 5543 | 137.0 | 7017 | 137.9 | 7546 |
| After Release | 104.2 | 5228 | 114.2 | 5486 | 135.4 | 6935 | 137.6 | 7528 |
| Before Pullout | 101.4 | 5088 | 114.2 | 5486 | 132.8 | 6802 | 136.4 | 7464 |
| At Pullout | 184.7 | 11129 | 191.7 | 26767 | 169.4 | 8850 | 192.2 | 22124 |
| Transfer % | 100% | | 100% | | 100% | | 100% | |
| Failure Type | Slip | | Slip | | Slip | | Fracture* | |

| | Test 5 | | Test 6 | | Test 7 | | — | |
|---|---|---|---|---|---|---|---|---|
| Test Stage | Force kN | μStrain mm/mm | Force kN | μStrain mm/mm | Force kN | μStrain mm/mm | — — | — — |
| Before Seating | 138.4 | 6608 | 140.1 | 6886 | 139.8 | 7512 | — | — |
| After Seating | 138.1 | 6601 | 139.8 | 6869 | 139.2 | 7477 | — | — |
| Before Release | 121.5 | 6330 | 127.8 | 6746 | 130.5 | 6093 | — | — |
| After Release | 120.9 | 6301 | 126.6 | 6685 | 129.4 | 6042 | — | — |
| Before Pullout | 119.9 | 6248 | 125.1 | 6606 | 127.8 | 5968 | — | — |
| At Pullout | 144.2 | 9765 | 137.2 | 9622 | 186.0 | 13156 | — | — |
| Transfer % | 100% | | 100% | | 100% | | — | |
| Failure Type | Fracture* | | Fracture* | | Fracture* | | — | |

*The strand fracture at the steel mechanical anchor behind the actuator. The UBA was intact, with the strand not showing any slip until wire fracture.

TABLE 0-16

Hoop Stress and Strain in the Steel Cone during Prestress Transfer

| | Test 4 | | Test 5 | | Test 6 | | Test 7 | |
|---|---|---|---|---|---|---|---|---|
| UHPC Size | Loc 1* | Loc 2* | Loc 1 | Loc 2 | Loc 1 | Loc 2 | Loc 1 | Loc 2 |
| μStrain Before Release | −90 | −22 | 0 | −19 | −17 | −43 | −39 | 18 |
| μStrain After Release | 162 | 124 | 94 | 111 | 196 | 37 | 187 | 113 |
| μStrain Change | 252 | 146 | 94 | 130 | 213 | 80 | 226 | 131 |
| Stress After Release (MPa) | 50.4 | 29.2 | 18.8 | 26.0 | 42.6 | 16.0 | 45.2 | 26.2 |
| Total μStrain at Pull-out | 290 | 223 | 98 | 132 | 215 | 84 | 258 | 141 |
| Stress (MPa) at Pull-out | 58.0 | 44.6 | 19.6 | 26.4 | 43.0 | 16.8 | 51.6 | 28.2 |

*Loc 1: Location of strain gauge; 31 mm away from the broader end of the cone.
Loc 2: Location of strain gauge; 88 mm away from the broader end of the cone.

Field Application of the UBA

In unbonded post-tensioned slabs, the typical PT layout of a two-way slab consists of distributed strands along one direction and banded strands in the perpendicular direction. The distributed tendons are typically in groups of two or three strands spaced around 1000 mm on centers, whereas the banded tendons consist of anywhere from 10 to 20 strands in a group along the column gridline. The UBA is envisioned to be easily applicable to both situations. From the test results, it is evident that a 75×75×300 mm UBA device is sufficient to anchor a single 12.7 mm prestressing strand without the need for any supplementary bursting reinforcement. Instead of having single pockets for each strand, the grouping of strands brings efficiency in field application. The recommendations for field application of the UBA are listed as follows.

The strands should be in a group consisting of a maximum of three strands with a minimum spacing of 75 mm between each strand. The block-out for the UBA should be 75 mm in depth, 325 mm in length, and in width should extend at least 35 mm beyond the extreme end strands. The block-out is located such that the strand passes at its mid-depth. This allows for any slab reinforcing steel running perpendicular to the strands to pass below or above the block-out without the need to curtail them. The outside surface of the block-outs should be provided with form-liners to create roughness on the concrete surface. The block-out should be located between 230 to 300 mm inside the slab edge. In the case of an edge-beam in the floor slab, the block-out can be placed immediately beyond the inside edge of the beam. A clear spacing of 300 mm between the block-outs should be provided. The sheathing on the strand should be removed in the block-out region, and the grease covering the strand should be cleaned up thoroughly. The bare portion of the strand should be indented per specifications and placed with the specified confining tube inside the block-out. During concreting, care should be taken to ensure concrete passes below the block-out. Once the concrete hardens and gains sufficient strength, the strands should be stressed and temporarily anchored using reusable anchors outside the slab edge. The block-out formwork should be removed at this time. UHPC should be poured in the block-out for a depth of 75 mm. It should be ensured that UHPC flows through and fills the confining steel. Once the UHPC sets, its top surface should be roughened, and concrete poured over it to match the top of the slab. Once UHPC gains a compressive strength of 100 MPa, the temporary anchor can be released. The tail end of the strand can be cut using an abrasive cutter.

As noted, this Example was intended to be directed towards the development of a UHPC bond anchor for unbonded post-tension systems. It can be concluded that the UBA can be used to anchor an unbonded post-tensioned strand. The mechanical performance of the UBA is significantly dependent upon the bond stress at the strand-UHPC interface. The UBA also mitigates or otherwise eliminates the need for additional encapsulation measures required for mechanical anchors in unbonded post-tensioned systems, including the need for pocket formers and grease-filled caps. The simplicity of the UBA anchor lies in the fact that the UHPC can be cast-in-place on site. There is no requirement to precast the UHPC to develop the anchor.

Additional takeaways, such as in the form of advantages, improvements, or the like, as has been shown by the foregoing, include, but are not limited to the following. The strand-UHPC interface bond is not affected by the steel fiber content of the UHPC. The fiber content can be limited to 0.50% of the UHPC volume.

Roughening the strands as prescribed increases the average bond stress from 0.33 kN/mm in smooth strands to about 0.50 kN/mm, an increase of about 51 percent.

Tensile tests showed that the roughened strands fracture at about 4 percent strain. As the CIP UHPC wedge does not bite into the strand, the possibility of premature strand fracture at low strains inside the UBA is eliminated.

The steel cone provides confining pressure to the UHPC and increases the average bond stress to 0.7 kN/mm, which is over two times that of the smooth strands and 1.5 times that of roughened strands.

No cracks were visible in any of the UBA's tested, which implies that the stiff cone absorbs all the energy from prestressing release but hardly dilates.

The sudden release of prestressing force by torching the strand is not recommended as it can damage the bond at the strand-UHPC junction, and lead to a slip failure.

An effective prestressing force of 134 kN can be transferred from the strand into the UBA within a 200 mm length.

A bond length greater than 200 mm and less than 305 mm is required to develop the ultimate tensile strength of the 12.7 mm prestressing strand.

The UBA, having dimensions of 75×75×300 mm, can also be used as an external anchor.

The prestressing strand can reach strains over 2% at ultimate loads with the stressing end UBA, although a better fixed-end anchor is required during testing to assess the actual strain capacity.

The UBA can be placed at a spacing of 75 mm on centers without the need for bursting reinforcement.

Therefore, the use of UHPC in unbonded post-tensioned systems provides better performing, highly durable, and cost-effective solutions to existing issues with anchorage zone and long-span slab-beam systems. The cast-in-place steel confined UHPC bond anchors (UBA) provides an easy to install alternative to the expensive encapsulated bearing anchors. The UBA also eliminates the issue of premature fracture experienced by the strand when used with mechanical steel anchors. The theoretical model developed to analyze the steel confined UHPC surrounding a prestressing strand during prestress transfer using the thick cylinder theory is a simple tool to use in lieu of the finite element analysis to design anchorages. It will also be useful to develop such devices for use with precast-prestressed systems to better their anchor zone performance. Similarly, the proposed composite UHPC-steel truss system (UCTA) reduces the structure self-weight by at least 25 percent, thereby also reducing the inertia mass forces, reducing column sizes, increasing the architectural appeal, and improving overall constructability. The findings from the analytical and experimental work are summarized below.

The UBA disclosed by the embodiments disclosed herein can successfully anchor 12.7 mm unbonded post-tensioned strands so that the strands are able to develop their ultimate tensile capacity with sufficient ductility. A UBA of size 75×75×300 mm successfully anchors the strand, develops the ultimate tensile capacity of the strand, and achieves over 2% ductility. As the UBA tests progressed, the strands fractured at the mechanical anchor located at the actuator pulling the strand. This proved that the UBA was intact and had better performance as compared to the mechanical anchors.

The UBA also mitigates or otherwise eliminates the need for additional encapsulation measures required for mechanical anchors in unbonded post-tensioned systems, including the need for pocket formers and grease-filled caps. The simplicity of the UBA anchor lies in the fact that the UHPC can be cast-in-place on site. There is no requirement to precast the UHPC to develop the anchor. The most important parameter that makes the UBA anchor the unbonded PT strand is the bond stress between the UHPC and the strand. The bond stress, in turn, is dependent upon the sudden release method of prestressing, the design of the steel confining device, the roughening methodology of the strand, and a good quality UHPC that can completely fill the confining device and create wedge action. The work on the UBA also confirmed that steel fibers have minimum influence on the bond properties or the design of the UBA. A fiber content between 0.5% to 1% appears to be more than sufficient for the UBA.

A new strand roughening procedure was developed during the process. Coupon tension tests on strand samples with the roughening procedure proved that the strands could strain around 4% strain before they fractured.

The sudden release of the prestressing force by the torching of the strand into a UBA without confining steel results in splitting cracks in the surrounding UHPC and total bond damage resulting in no prestress transfer and thus, total loss of stress in the strand. Even if the strand is gradually released, breaking of the individual wires of the strand one after the other results in consecutive bond damage at the UHPC-strand interface. If the prestressing wires are not cut during the slow release process, it does not damage the strand-UHPC bond inside the UBA. Use of a full-length spiral reinforcing inside the UBA is capable of successfully arresting cracks in the UHPC resulting from a sudden prestress release procedure by the torching of the strand. A combination of intentional strand indentation and a use of a thick confining cone with external grooves or ribs inside the UBA can successfully anchor the unbonded strand during prestress transfer as well as at ultimate loads with sufficient ductility.

Smooth confining cones do not perform well as it provides insufficient bearing against UHPC. The slip of cone against the surrounding exterior UHPC causes sufficient bond damage and renders it ineffective to anchor the unbonded PT strand. The strand-UHPC interface bond is insignificantly affected by the steel fiber content of the UHPC. Roughening the strands as prescribed increases the average bond stress from 0.33 kN/mm in smooth strands to about 0.50 kN/mm, an increase of about 51 percent.

As the CIP UHPC wedge does not bite into the strand, the possibility of premature strand fracture at low strains inside the UBA is eliminated. The steel cone provides confining pressure to the UHPC and increases the average bond stress to 0.7 kN/mm, which is over two times that of the smooth strands and 1.5 times that of roughened strands.

No cracks were visible in any of the UBA's tested, which implies that the stiff cone absorbs all the energy from prestressing release but hardly dilates. An effective prestressing force of 134 kN can be transferred from the strand into the UBA within a 200 mm length. A bond length greater than 200 mm and less than 305 mm is required to develop the ultimate tensile strength of the 12.7 mm prestressing strand.

The UBA, having dimensions of 75×75×300 mm, can also be used as an external anchor. The UBA can be placed at a spacing of 75 mm on centers without the need for bursting reinforcement.

The superior mechanical properties of UHPC allows it to be applied for long-span floor slab application. Prestressing can be effectively used with UHPC due to the latter's ultra-high compressive strength. The UCTA system as disclosed herein efficiently uses UHPC and results in about 25 percent weight reduction of a building structure in comparison to a building with a CIP-PT floor system. The direct material cost of a building utilizing the UCTA is comparable to the CIP-PT building and hence will be attractive for future developments. The UCTA will result in a leaner seismic resisting and gravity system, allowing for more floor area for architectural functionality. The UCTA system is highly efficient both in weight and cost. Use of UHPC only in the top and bottom chords compositely connected to the steel webs optimizes the truss, which can then be compositely used with either precast prestressed or post-tensioned decks.

The design method disclosed herein, along with a new flexural model and a creep model for composite structures, will make the UCTA design easy for routine design work in an engineering office. For the efficient design of the embedded anchor stud assembly for web member connection, additional push-out tests are required to take advantage of the UHPC mechanical properties.

Monolithic truss-type open-web UHPC beams, on the other hand, are the most volume efficient and result in about 40 percent reduction in the beam weight, but their webs are prone to premature tension failure and require confined passive reinforcement to eliminate this failure mechanism and ensure the ductile failure of the truss bottom chord. Application of the monolithic UHCP truss to a building system also helps reduce the overall self-weight of the structure by about 38%, but the volume of UHPC makes the structure about 1.6 times more expensive than the conventional CIP-PT slab system.

From the foregoing, it can be seen that the invention accomplishes at least all of the stated objectives.

The invention claimed is:

1. A cast-in-place ultra-high-performance concrete bond anchor (UBA), comprising:

a roughened steel strand;

a cone surrounding the roughened steel strand; and a layer of ultra-high-performance concrete (UHPC) positioned between the roughened steel strand and the cone;

wherein the UBA does not include plastic encapsulation or grout.

2. The UBA of claim 1, wherein the cone comprises steel.

3. The UBA of claim 2, wherein the cone comprises a plurality of grooves on an external portion of the cone.

4. The UBA of claim 2, wherein the cone comprises a plurality of externally protruding ribs along the length of the cone.

5. The UBA of claim 4, wherein the cone comprises a length of approximately 175 mm being tapered, and approximately 25 mm extending from the tapered section and having a substantially non-tapered diameter.

6. The UBA of claim 5, wherein the thickness of the cone is approximately 3 mm.

7. The UBA of claim 6, further comprising at least one spout extending through a wall of the cone to allow the UHPC to be added to the interior of the cone.

8. The UBA of claim 1, wherein the roughened steel strand comprises a plurality of indents along the length of the strand.

9. The UBA of claim 3, wherein the strand is approximately 12.7 mm in diameter.

10. The UBA of claim 1, further comprising an external layer of UHPC external of the cone.

11. A method of prestressing concrete using a cast-in-place ultra-high-performance concrete bond anchor (UBA), the method comprising:

positioning steel strands in an area to be poured with concrete;

creating a stressing end block-out form in the area;

surrounding the steel strands with UHPC and a tapered steel cone with grooves or ribs;

pouring concrete around the form in the area to create a concrete slab;

stressing the strands;

pouring ultra-high-performance concrete (UHPC) in the block out form; and releasing the stress on the strands.

12. The method of claim 11, wherein the step of stressing the strands comprises connecting an external anchor to the strands at a location external of the concrete and block-out.

13. The method of claim 12, wherein the step of releasing the stress on the strands comprises releasing the external anchor from the strands.

14. The method of claim 12, wherein the step of stressing the strands comprises connecting a jack to the strands to stress the strands.

15. The method of claim 11, further comprising removing an external portion of the strands after the UHPC has cured and hardened.

16. The method of claim 11, further comprising waiting until the UHPC has gained a compressive strength of 100 MPa before releasing the stress on the strands.

17. The method of claim 11, further comprising:

roughening the steels strands.

18. A method of forming a cast-in-place ultra-high-performance concrete bond anchor (UBA), comprising:

roughening a steel strand used in forming a concrete slab;

surrounding at least a portion of the roughened steel strand with a cone, said cone being at least partially tapered along its longitudinal length and including grooves or ridges around the cone; and pouring ultra-high-performance concrete (UHPC) between the roughened steel strand and the cone;

wherein the UBA does not include plastic encapsulation or grout.

19. The method of claim 18, further comprising pouring UHPC around the cone, UHPC and roughened strand to anchor the UBA in concrete.

20. The method of claim 19, further comprising stressing the roughened strands prior to pouring UHPC around the cone, UHPC and roughened strand to anchor the UBA in concrete.

* * * * *